US006220138B1

(12) United States Patent
Sakamoto

(10) Patent No.: US 6,220,138 B1
(45) **Date of Patent: *Apr. 24, 2001**

(54) PUNCH PRESS

(75) Inventor: Hiroichi Sakamoto, Kagamihara (JP)

(73) Assignee: Murata Kikai Kabushiki Kaisha, Kyoto (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/067,682

(22) Filed: Apr. 28, 1998

(30) Foreign Application Priority Data

Jan. 27, 1998 (JP) ..... 10-013799

(51) Int. Cl.[7] ..... B26D 7/28
(52) U.S. Cl. ..... 83/639.1; 83/98; 83/99
(58) Field of Search ..... 83/99, 98, 639.1

(56) References Cited

U.S. PATENT DOCUMENTS 3,550,491 * 12/1970 Wingard ..... 83/99
4,628,780 * 12/1986 Hicks ..... 83/99
5,111,723 * 5/1992 Andrusch et al. ..... 83/99
5,448,933 * 9/1995 Grabbee ..... 83/98

FOREIGN PATENT DOCUMENTS

880886 * 5/1953 (DE) ..... 83/99
2637085 * 2/1978 (DE) ..... 83/99

* cited by examiner

*Primary Examiner*—M. Rachuba
*Assistant Examiner*—Sean Pryor
(74) *Attorney, Agent, or Firm*—Hogan & Hartson, LLP

(57) ABSTRACT

A punch press, adapted to receive a punch tool having a passage for discharging a fluid for ejecting slugs punched out during the punching process, includes a movable ram means for striking the punch, the ram means having a bottom dead position and including a passage connectable to the passage of the punch when the ram means strikes the punch. The press further includes a valve for controlling the supply of the slug-ejecting fluid to the ram means, the valve comprising a movable member responsive to the vertical motion of the ram means and a stationary member relative to which the movable member slides, the valve being adapted to control the flow of the fluid to the ram means, the valve being open while the ram means is positioned within a predetermined positional range including but not limited to, the dead bottom position of the ram means.

13 Claims, 19 Drawing Sheets

PUNCH PRESS

BACKGROUND OF THE INVENTION

1. Field of the Invention

The present invention relates to a punch press provided with a function for forcing out a slug punched out during a punching process.

2. Description of the Prior Art

A conventional punch press that prevents a punched out slug from popping up from the die holder during punch processing by connecting passages in the ram and the punch to form a single passage for flowing high-pressured air in order to force out the slug has been proposed. When the ram nears its dead bottom position, the passage inside the ram connects with the passage formed inside the ram guide, and compressed air is discharged from the bottom of the punch. The force of this air ejection prevents the slug from popping up as the punch is relifted, and causes the slug to drop out.

However, sometimes air ejection at the predetermined dead bottom position is insufficient to prevent the slug from popping up. Moreover, if the height of all the punches in the punch press are not constant, even if the ram is arranged such that air discharge occurs when the ram reaches its dead bottom position, optimal timing of the air discharge (optimal timing in order to prevent the slug from popping up, or in other words, discharge timed to the punching action) differs with each different punch. Further, even if punches of a uniform height are used, when some punches are shortened due to abrasion and repeated use, the height at which the end of the punch and the surface of the die meet and the set punching height may differ, causing the air ejection to occur before the punch hits the work, and causing the force of the air discharge to be insufficient to effectively prevent the slug from popping up. The slug can be prevented from popping up by flowing a constant stream of air through the punch, but this wastes most of the air and is not very economical.

In order to solve this problem, a means to detect the strike position of the ram, and to open and close a valve in response to the signal detected has been proposed. However, since accurate timing is necessary to supply air to the punch when the ram strikes the punch, a quick-response valve must be provided, increasing the cost of the punch press.

BRIEF DESCRIPTION OF THE INVENTION

It is a first object of the present invention to propose a simple punch press which reliably forces out a punched out slug, is energy-efficient, and has a simply designed fluid control mechanism.

Another object of the present invention to provide a punch press which conducts the fluid supply through the machine using simple parts, and which does not mar the surface of the work with the ejection of the fluid.

An additional object of the present invention is to simplify the timing of the discharge of the fluid.

An additional object of the present invention is to enable a punch press in which a moveable striker provided in the ram means can selectively strike a plurality of punch tools and reliably force the slug to drop out.

An additional object of the present invention is to achieve a simple design in which the air discharge is accurately timed to the ascension and descention of the ram means.

In accordance with one, specific, exemplary form of the invention, there is provided a punch press having a ram means containing a passage that aligns with a passage in a punch tool when the punch tool is struck by the ram means. A valve controls a supply of fluid to the ram means, the passage in the punch tool permitting fluid to be discharged from the punch tool passage to eject the slug. The valve is comprised of two sections, a movable section which slides in correlation with the rise and fall of the ram means, and a stationary section which does not move. This valve is arranged such that the valve is maintained in an open state within a fixed vertical range of the rise and fall of the ram means which includes the ram means' dead bottom position.

In a punch press according to the invention, the valve is opened in response to the sliding of the movable valve section relative to the fixed valve section each time the ram means strikes the punch tool, ejecting fluid from the punch tool passage. The slug struck by the punch tool is forced out by the discharge of fluid, and is thus prevented from popping up when the punch tool is lifted. Moreover, the valve maintains an open conduit over a fixed range of the rise and fall of the ram means including the point where the ram means reaches its dead bottom position. In other words, fluid discharge is not limited to a single instant in which the ram reaches its dead bottom position, but occurs even after the ram has reached its dead bottom position, continuing until the ram means passes beyond the predetermined vertical range. Thus, the fluid discharge reliably prevents the slug from popping up. Further, the punch press of the present invention achieves greater energy efficiency than a punch press in which fluid discharge occurs continuously since fluid discharge in the present invention occurs after the punch has punched out the slug, and then only when the ram means is located within the fixed vertical range which allows the valve to open. Finally, since the opening and closing of the valve occurs with the movement of the ram means, a separate driving source is unnecessary, and the design of the machine can be simplified.

In a punch press comprised as described above, the fluid should preferably be compressed air. If the ejected fluid is compressed air, the facility for supplying the fluid can be simplified, and even if the fluid is discharged to the surface of the work before the punch makes contact with the work, the surface of the work will not be sullied by the fluid.

Further, according to a punch press of the present invention, the valve may be composed of a sliding section comprised of a plate-shaped movable member bodily attached to the ram means provided with a passage, and a block-shaped stationary member against which the movable member slides vertically. The term "bodily attached" is herein defined as "attached so as to move as a single body." The stationary member is provided with a fluid inlet hole and a fluid outlet hole that are normally obstructed by the plate-like surface of the movable section. These inlet and outlet holes align to connect with a through-hole formed in the movable member in accordance with the rise and fall of the movable member. The ram means and the movable member are "bodily attached," but as per the definition listed above, may actually be formed as separate elements that are fixed to each other enabling them to move as a single unit.

With such a design, the fluid inlet hole and the fluid outlet hole of the stationary member are normally obstructed by the plate-like surface of the movable member, or simply put, the valve is normally closed. When the plate-like movable member rises and falls with the movement of the ram means, the fluid inlet and outlet holes in the stationary member come into alignment with the through-hole in the movable member, opening the valve. Hence, the valve design is such that the plate-shaped movable member and the block-shaped stationary member are simply constructed cost-effective elements.

The ram means of such a punch press may be comprised of the ram body, and a striker portion which is attached to the bottom of the ram body and may be slidable laterally relative to the ram body. The passage inside the ram means may be provided in the striker portion. In a punch press so comprised, even if the position in which the ram body rises and falls is fixed, by changing the position of the striker, a plurality of punch tools can be selected for striking. Thus, the punch holding means can be equipped with multiple punch tools, and since the passage inside the ram means is provided inside the striker, air can be supplied to the selected punch tool regardless of which punch tool the striker is positioned over.

The valve of such a punch press may be positioned adjacent one side of the ram means, and the fluid outlet hole of the valve and the fluid inlet hole of the ram means may be connected by a fluid pipe. In such case, since the valve is provided adjacent one side of the ram means, the valve does not directly bear the load of the punch tool when it is operated, thereby avoiding damaging the valve.

Further, since the valve is arranged at a distance from the ram means and the fluid ejection passage of the valve and the fluid inlet passage of the ram means are connected by a pipe, it is possible to design the ram means and the valve as separate units. Thus, the valve can be designed with a simple structure and a degree of freedom. Consequentially, the accurate timing of the air discharge corresponding to the vertical position of the ram means can be designed simply.

Further objects, advantages and features of the invention will become apparent from the detailed description, below, when read in conjunction with the accompanying drawings.

DETAILED DESCRIPTION OF THE INVENTION

Figure 1:
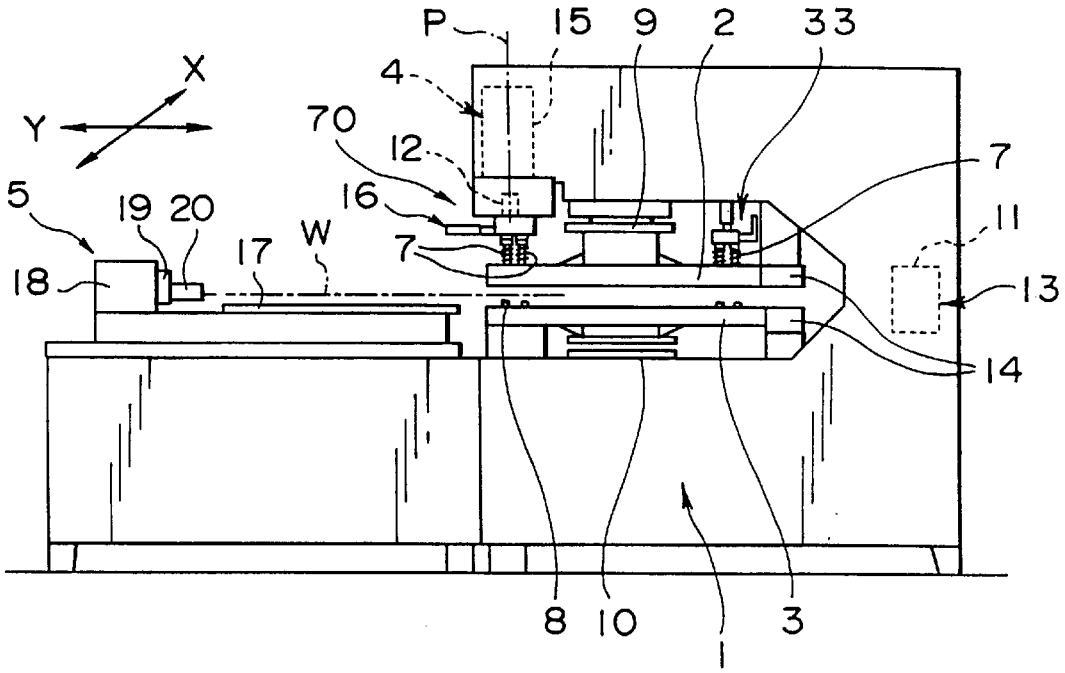
FIG. 1 is a side elevation view of a punch press according to a first embodiment of the present invention.
Figure 2:
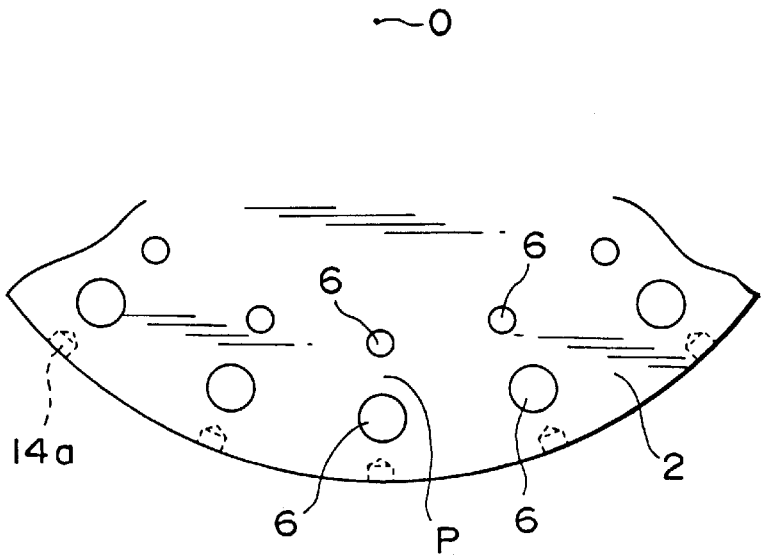
FIG. 2 is a top plan view of a portion of the turret of the punch press of FIG. 1.
Figure 3:
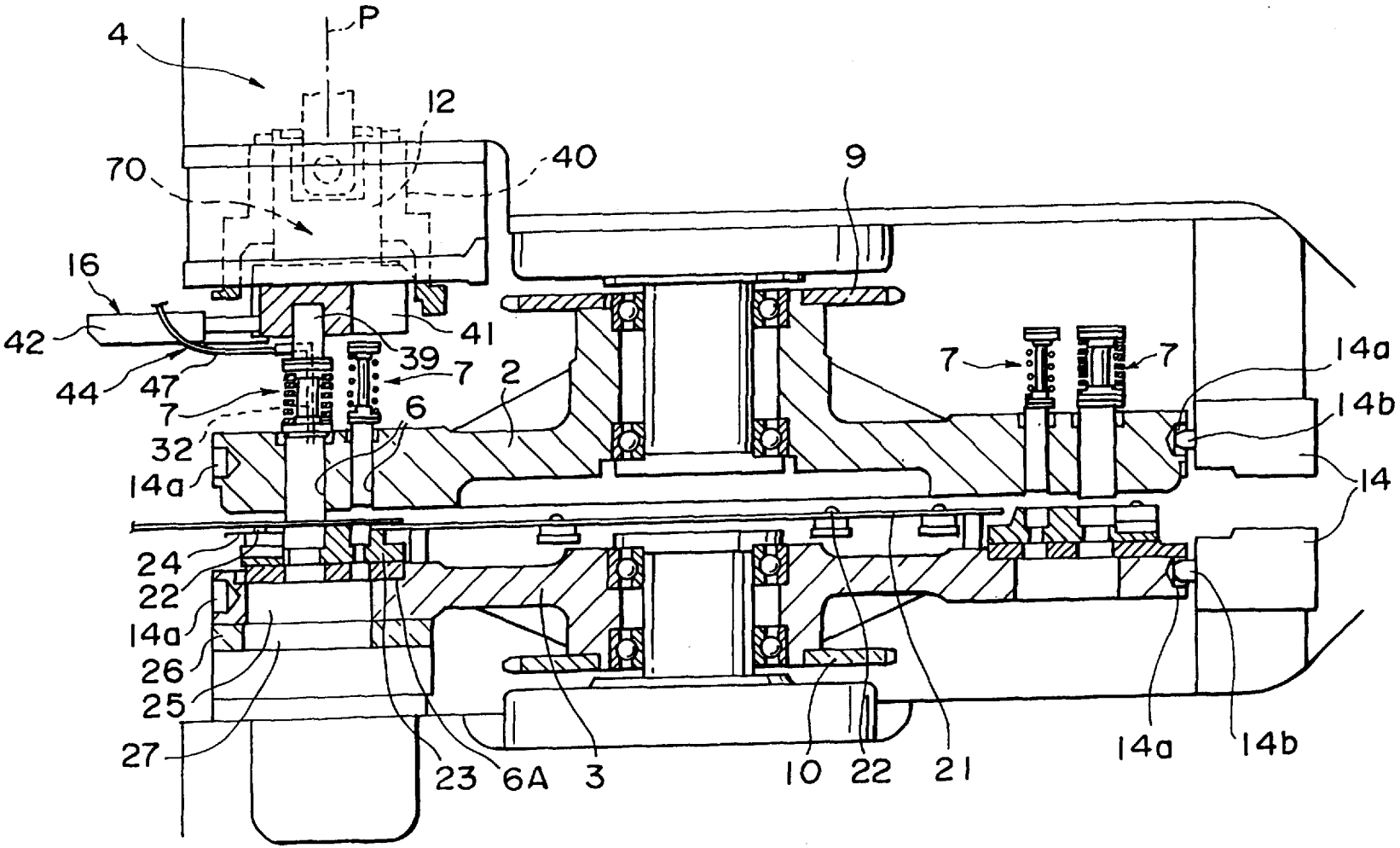
FIG. 3 is an enlarged, side elevation view, partly in cross section, of the turret and the portion surrounding the turret of the punch press of FIG. 1.

A first preferred embodiment of the present invention is now explained in reference to FIG. 1 through FIG. 10. The punch press of this embodiment is provided with upper and lower turrets 2 and 3 which form the punch holding means, a punch driving mechanism 4, and a work transporting mechanism 5 attached to a frame 1. The frame 1 forms a C shape when viewed from the side, with the upper and lower turrets 2 and 3 provided at the concave portion of the C-shaped frame 1, and the said upper and lower turrets 2 and 3 each supported so as to rotate around the same central axis.

The upper turret 2 is provided with multiple rows of punch holders 6 for a punch 7 (FIG. 2) lined up on the circumference around the center of the disk. These punch holders 6 are formed as through-holes, and are arranged in the same concentric plane around the center axis O of the upper turret 2. An inner row punch holder 6 and an outer row punch holder 6 form a punch holder set arranged on the same radii from the origin around the turret 2. Each punch 7 is arranged so as to rise and fall into its corresponding punch holder 6.

The lower turret 3 is provided with holders 6A (FIG. 3) for dies 8 which are lined up on the circumference along the same radii from the center of the disk. The die holders 6A of the dies 8 are arranged so as to face upwards to meet each punch 7 of the upper turret 2. The upper and lower turrets 2 and 3 are provided with center sprockets 9 and 10, respectively, and by means of common motor 11 attached to the frame 1, are synchronously rotated by a drive imparting mechanism like a chain (not shown in the drawings). An index means 13 which positions the desired punch 7 and die 8 combination at the center of a ram 12 is comprised of the motor 11 and the drive imparting mechanism. The ram 12 is a striking means for the punch 7. Further, the outer radial surface of the upper and lower turrets 2 and 3 are furnished with position determining holes 14*a* that are positioned opposedly to their corresponding punch holders 6. These position determining holes 14*a* engage with an index pin 14*b* to hold the turrets 2, 3 in position while a pair of index position holding mechanisms 14 that precisely determine the index angle at which the turrets 2, 3 are held are provided at the back end of the frame 1. The index position holding mechanism 14 is comprised from a cylinder device that moves the index pins 14*b*.

The punch driving mechanism 4 is provided with the ram 12 that strikes the punch 7, and a punch driving source 15 that drops and lifts the ram 12. The punch driving mechanism 4 can be either mechanical or hydraulic. In this example, it is hydraulic, with the punch driving source using an oil pressure cylinder. A strike position selection mechanism 16 which selectively drives the punch 7 of the inner or outer row of punch tools on the turret 2 is provided at the ram 12. The strike position selection mechanism 16 is arranged as described below.

The work transporting mechanism 5 is a means for transporting the work sheet laid out on a table 17 to the specified ram position P. The work transporting mechanism 5 is provided with a carriage 18 which moves backwards and forwards (along the Y axis) and attached a cross slider 19 which can move left and right (along the X axis). Multiple work holders 20 which grip the ends of the work W are attached to the cross slider 19.

Free bearings (not shown in the drawings) which support work W are provided in the table 17. Further, as described in FIG. 3, a turret portion table 21 is provided on the upper surface of the lower turret 3, in which the said turret portion table 21, the free bearings 22 are provided. A die portion table 24 is provided at a die holder 23, in which free bearings 22 are also provided. The die holder 23 is provided at every position of the inner and outer rows of the lower turret 3 supporting the die 8. The lower turret 3 is provided with a slug drop hole 25 at each position of the die 8, and a punch load receiving portion 26 at the ram position P of the lower turret 3 is similarly provided with a slug drop hole 27.

Figure 4:
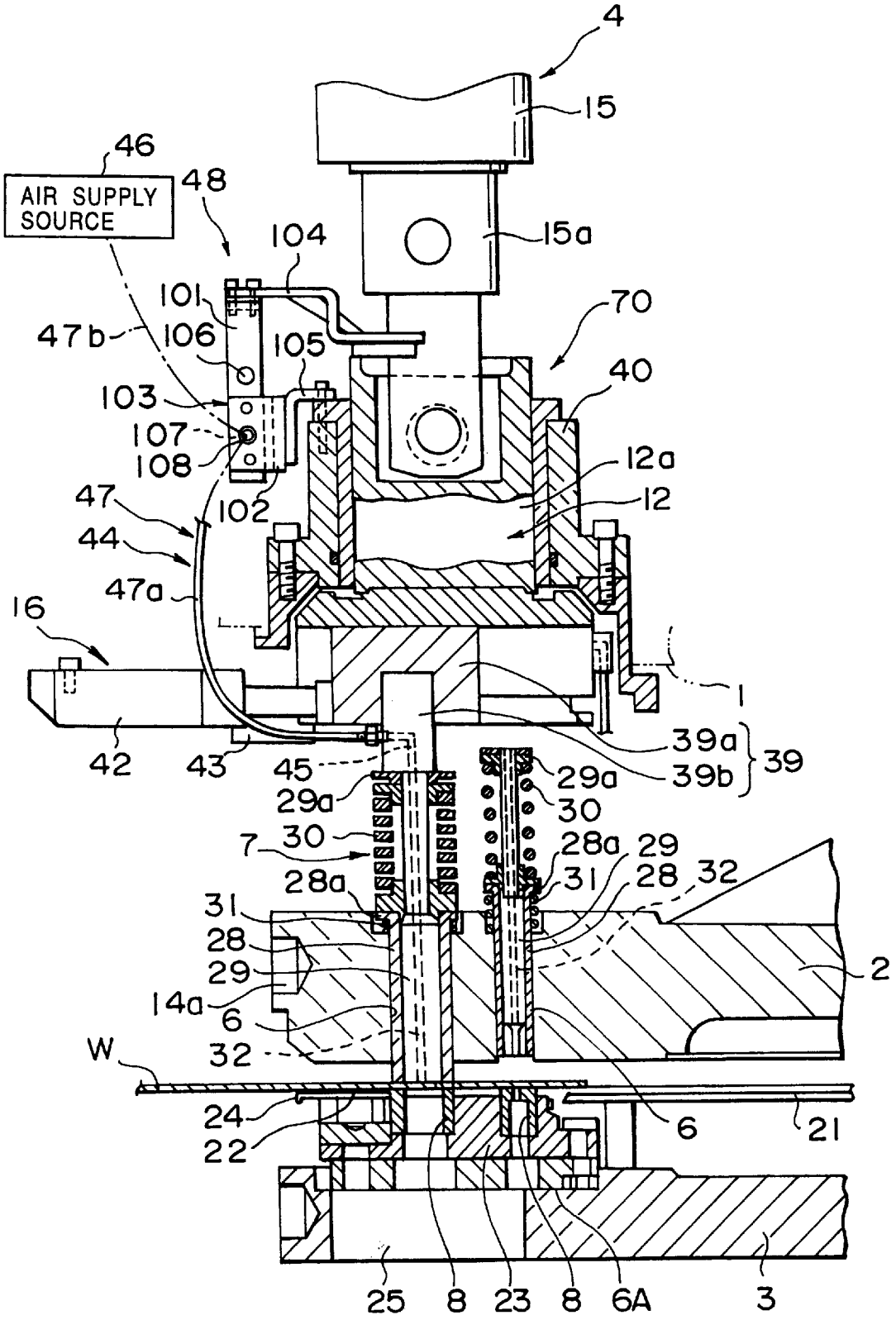
FIG. 4 is an enlarged, side elevation view, partly in cross-section of part of the punch and die set and the punch driving mechanism of the punch press of FIG. 1.

As shown in FIG. 4, each punch 7 is provided with a tubular guide member 28 which is combined with the stripper and shearing blade body 29 which is engaged inside a tubular guide member 28 so that it may rise and fall independently. A first restoring spring 30 holds the shearing blade body 29 in a rising state against the guide member 28. The top end of the shearing blade body 29 thrusts upward against the guide member 28, and the first restoring spring 30 is provided positioned between a flange spring receiving part 29*a* provided at the top end of the shearing blade body 29 and a flange part 28*a* provided at the top end of the guide member 28. The punch 7 is supported so as to rise and fall in the turret 2 such that it fits into and rises and falls in the punch holder 6. Further, the punch 7 is held with constant rising tension in the turret 2 by a second restoring spring 31, an elastic body positioned between the flange part 28*a* and the surface of the turret 2.

Since the second restoring spring 31 is of a slightly smaller spring constant than the first restoring spring 30, when the top surface of the punch 7 is pushed by the ram 12, first the second restoring spring 31 is depressed and the entire punch 7 drops down, and pressure is exerted on work W from the lower surface of the guide member 28. Next, the first restoring spring 30 is depressed and the shearing blade body 29 drops down against the guide member 28, opening a punch hole in work W. When the ram 12 rises after reaching its dead bottom position, the shearing blade body 29 is lifted in reverse with the restoring force of the first restoring spring 30, and after the shearing blade body 29 has pulled out of the punch hole in work W, the entire punch 7 is lifted with the restoring force of the second restoring spring 31. Because of this action, the guide member 28 accomplishes the stripping function by means of the first restoring spring 30 when the shearing blade body 29 pulls out of the punch hole.

The supply of lubricating oil (oil mist) to parts such as the punch 7 must be applied manually by the operator at some place remote from the punching location. However, if it is done automatically, it is necessary to make sure all parts are lubricated.

As shown in FIG. 4, the ram 12 of the punch driving mechanism 4 is comprised of the ram body 12*a* and a striker 39 of a strike position selection means 16 provided at the bottom of the ram 12. The ram body 12*a* is held so as to rise and fall freely inside a ram guide 40 provided in the frame 1, and is connected to a piston rod 15*a* of the punch driving source 15 comprised of a hydraulic cylinder. A ram means 70 is comprised of the ram 12 and the ram guide 40.

The strike position selecting means 16 is arranged so as to move the striker 39 laterally in a striker guide 41 provided at the bottom end of the ram body 12*a*. The striker 39 is comprised of a guide receiver 39*a* which is guided by the striker guide 41, and the striker body 39*b* which strikes the upper surface of the punch 7 which is fixed below the guide receiver 39*a*. The strike position selection means 16 moves the striker 39 by means of a selecting cylinder 42 which comprises the striker moving means. The direction of the lateral movement of the striker 39 in the present embodiment is in the radial direction of the turret. The cylinder body of the selecting cylinder 42 is attached to the striker guide 41 by means of a supporting mechanism 43.

An air supply means 44 is comprised of a passage 45 formed in the striker 39 of the ram 12, a fluid supply passage 47 which is connected between an entrance of the passage 45 and a fluid supply source 46, and a valve 48 connected to the fluid supply passage 47. An outlet hole of the passage 45 formed in the striker 39 connects to a passage 32 of the punch 7. A flexible fluid pipe 47*a* connects a fluid outlet hole 108 (FIG. 6) on the valve 48 with the passage 45 in the striker 39. Further, a fluid inlet hole 107 on the valve 48 and the fluid supply source 46 are connected by a flexible fluid pipe 47*b*.

Figure 5:
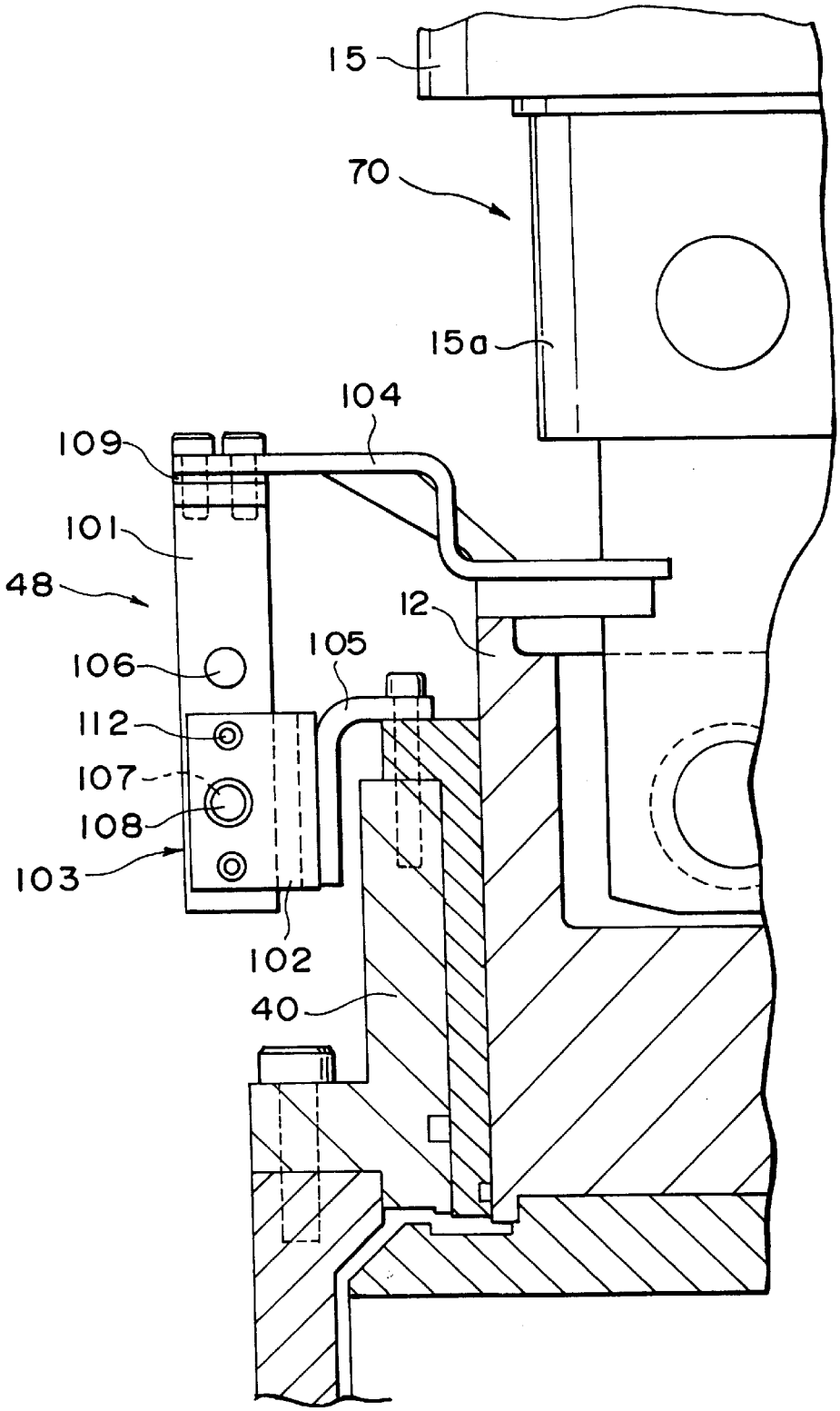
FIG. 5 is an enlarged, side elevation view, partly in cross-section, of a portion of the apparatus of FIG. 4 showing details of a valve in accordance with one aspect of the present invention.
Figure 6A:
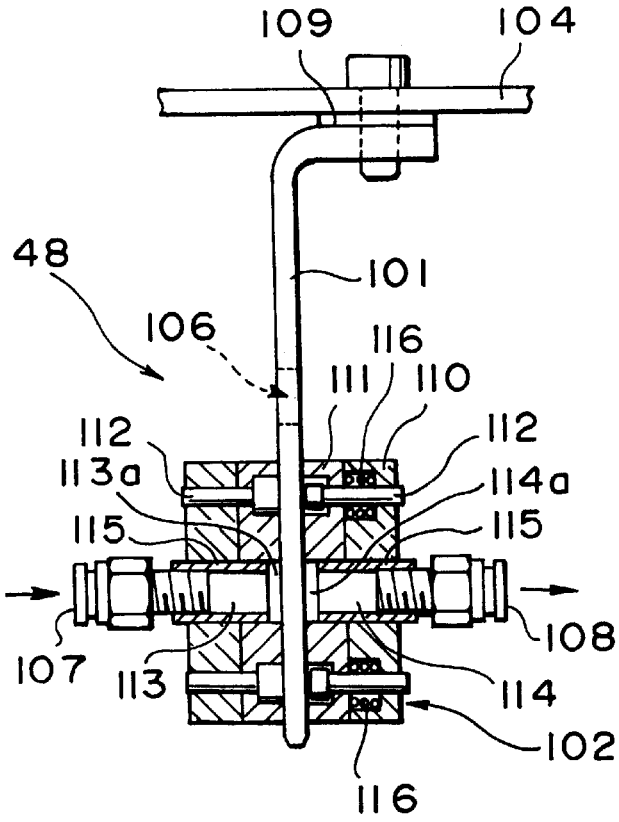
FIG. 6A is a front elevation view, partly in cross-section, of the valve of FIG. 4.
Figure 6B:
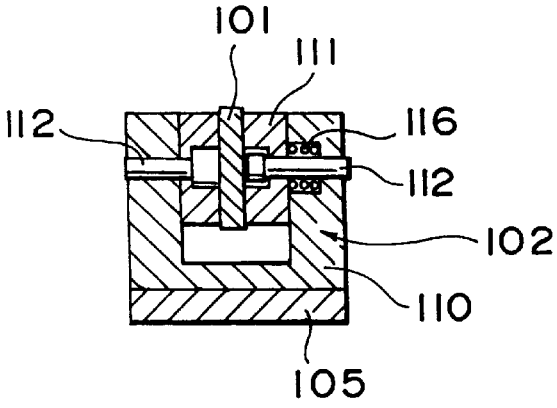
FIG. 6B is a top plan view, in cross-section, of the valve of FIG. 4.

As shown in FIG. 5, the valve 48 is provided at a sliding part 103 which is formed by a plate-shaped movable member 101 and a block-shaped stationary member 102 which sandwiches the movable member 101, and rises and falls the movable member 101. The movable member 101 is provided with a through-hole 106, and is attached bodily to the ram means 70 by means of a connecting member 104 which bridges the upper section of the movable member 101 with the ram 12. The connecting member 104 and the movable member 101 are bolted together through a shim 109. The stationary member 102 is attached to the ram guide 40 through a fastening member 105.

As shown in FIG. 6, the stationary member 102 is provided with the fluid inlet hole 107 and the fluid outlet hole 108 which are aligned through the through-hole 106 according to the rise and fall of the movable member 101. The fluid inlet hole 107 and the fluid outlet hole 108 are normally obstructed by the plate-like surface of the movable member 101, and can be connected through the through-hole 106 according to the rise and fall of the movable member 101 which rises and falls with the movement of the ram means 70. This valve 48 can be set to maintain an open conduit over a fixed or predetermined vertical range of the rise and fall of the ram means 70 which range includes, but is not limited to, the dead bottom position of the ram means 70.

The stationary member 102 is comprised of a stationary member body 110 which is formed in a U shape with parallel opposing valve body portions or sides (FIG. 6B), and a pair of contact members 111, 111 which are provided inside each of the sides of the stationary member body 110. These contact members 111 in each side of the stationary member body 110 are held so as not to slip out, but allowed to move toward the movable member 101 through pin-shaped guides 112. One of the contact members 111 is pushed in the direction of the movable member 101 by a spring 116. This pressure is exerted towards the plate-shaped movable member 101 from the opposing surfaces of the contact members 111, 111 causing the movable member 101 to be flexibly gripped.

Opposing passages 113, 114 as through-holes are formed in each respective side of the stationary member body 110 of the stationary member 102, and in each respective contact member 111. Inside each of these passages 113, 114, a sleeve 115 is inserted, and the outer ends of each sleeve 115 are attached through nuts to the fluid inlet hole 107 and the fluid outlet hole 108, respectively. The sleeves 115 are arranged such that they cut off and do not reach the through-hole 106 side openings 113*a*, 114*a* of each passage 113, 114. Each opening 113*a*, 114*a* is formed directly in the contact member 111 as well. The openings of the through-hole 106 of the movable member 101 and the openings 113*a*, 114*a* of the stationary member 102 are circular in this embodiment, but other shapes can be used.

Figure 9:
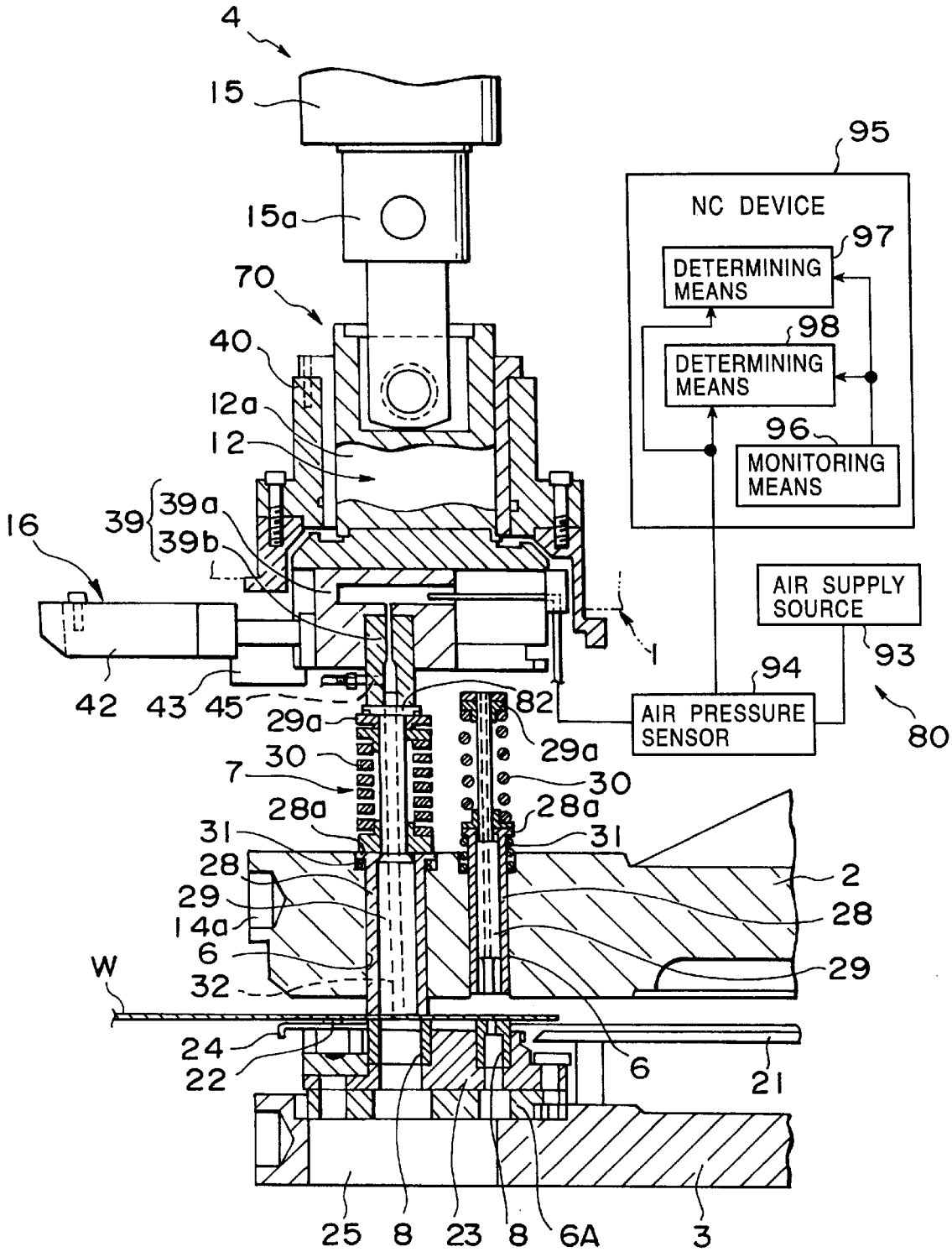
FIG. 9 is a side elevation view, partly in cross-section, of a punch press in accordance with another aspect of the present invention directed to a malfunction detection means.

As shown in FIG. 9, the punch press of the present invention is equipped with a malfunction detection means 80 which detects irregular conditions in the machine like strip failures. The malfinction detection means 80 is comprised as described below.

The striker body 39*b* in the ram 12 is provided with an operating member 82 which normally exerts pressure downwards by means of a spring 81, as shown in FIG. 10. The operating member 82, which rises when the striker body 39*b* meets the top of the punch 7, is comprised of a board-shaped operating body 82*a* and an elevating guide part 82*b* which rises from the middle of the top of the operating member 82. The top of this elevating guide part 82*b* forms a valve 82*c*. The position of the operating member 82 in the striker body 39*b* is set at a fixed distance from the center of the part of the punch 7 that is struck, as shown in FIG. 10B and FIG. 10C. The operating body 82*a* is arranged so that it can sink into and emerge out of an operating body, encasement groove 84 which is situated at the aforementioned predetermined distance from the punch. The passage 45 which is used to force out the slug is provided in the center of the striker body 39*b*, and does not connect with the operating member 82.

A guide hole 86 which guides the rise and fall of the elevating guide part 82*b* in the operating member 82 is formed such that it partially ascends the inside surface of the operating body encasement groove 84. The guide hole 86 is a fluid passage used as the detector. A fluid passage 87 of slightly smaller diameter than the guide hole 86 is formed above the guide hole 86 in a vertical direction entering into the guide receiver 39*a* of the striker 39. A spring 81 which exerts downward force on the operating member 82 is arranged in the guide hole 86, and is engaged between the top of the elevating guide part 82*b* of the operating member 82 and the top of the guide hole 86. The spring constant of the spring 81 is set to a relatively smaller value than that of the first or second restoring springs 30 and 31 of the punch 7. Further, a brace 82*d* is formed so that it juts out from both ends of the top of the operating body 82*a*, and a ring-shaped stopper 88 is arranged in the bottom of the striker body 39*b* so as to block the brace 82*d*. Thus, the thrusting force brought against the operating member 82 from the bottom of the striker body 39*b* is kept below a fixed level by the stopper 88.

An air exhaust passage 89 extending laterally in the striker 39 and opening into the outer surface of the striker body 39*b* connects to the middle of the passage of the guide hole 86 in the striker body 39*b*. The air exhaust passage 89 is positioned such that when the striker body 39*b* meets the top of the punch 7 causing the operating member 82 to rise (FIG. 10A), the valve 82*c* of the operating member 82 blocks the air exhaust passage 89, and such that when the striker body 39*b* is not in contact with the top of the punch 7 and the operating member 82 descends (FIG. 10D), valve 82*c* opens the air exhaust passage 89.

Figure 10A:
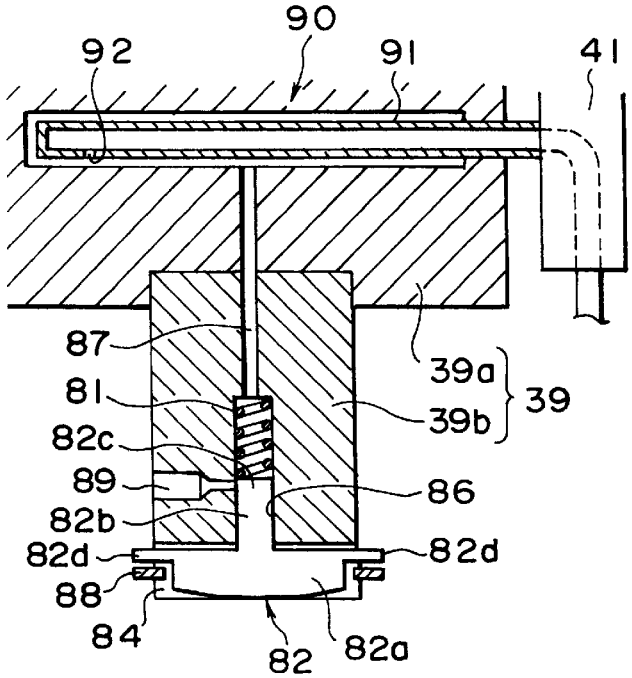
FIGS. 10A and 10D are side elevation views, in cross-section, showing details of the malfunction detection means of FIG. 9.
Figure 10B:
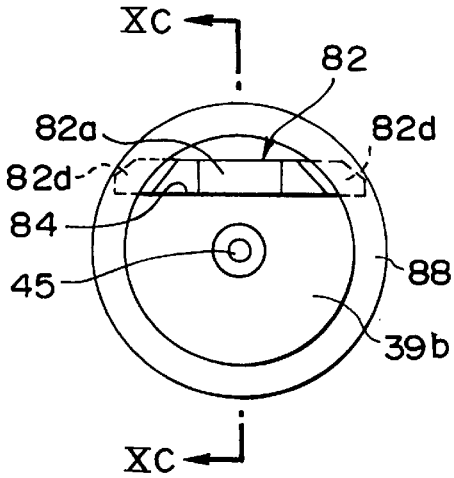
FIG. 10B is a bottom plan view of the malfunction detection means.
Figure 10C:
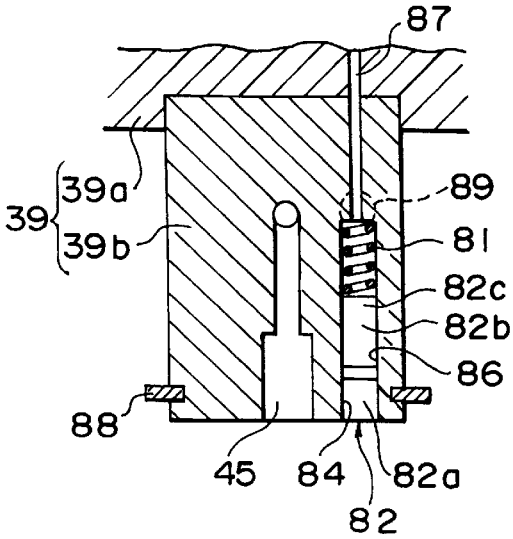
FIG. 10C is a cross-sectional view taken along the line XC—XC in FIG. 10B.

As shown in FIG. 10A, in the striker body 39*b* which comprises the striker 39, a lateral air supply passage 90 which connects to the air passage 87 in the striker body 39*b* is formed in the direction of the lateral movement of the striker 39. An air supply pipe 91 which is connected to the striker guide 41 is inserted into the air supply passage 90. The air supply pipe 91 is provided with the air outlet hole 92. This air supply pipe 91 ensures that the air supply reaches the air supply passage 87 in the striker body 39*b* without having to laterally move the striker 39. As shown in FIG. 9, the air supply pipe 91 is connected to an air supply source 93, and an air pressure sensor 94 which functions as a detection means for detecting the state of the operating member 82 is arranged between the air supply source 93 and the air supply pipe 91. The air pressure sensor 94 is equipped with something like a switch. The air passage 87 inside the striker body 39*b* and which runs into the air pressure sensor 94 switches between connected and obstructed states by means of opening and closing of the air exhaust passage 89 by a valve 82*c* in response to the sinking and rising of the operating member 82. Thus the air pressure sensor 94 can detect changes in the backwards pressure of the air supplied as far as the operating member 82 which correspond to the sinking and rising of the operating member 82. The air pressure sensor 94 may also be provided in the air exhaust passage 89.

An NC device is used as the control device 95 for controlling the entire punch press. This control device 95 is equipped with a numerical control function and a programmable controller. The control device 95 is provided with a monitoring means 96 which monitors the rise and fall of the ram 12, and two determining means 97, 98 which determine whether there is a mechanical malfunction. The monitoring means 96 can either monitor the vertical position of the ram 12 via the output of a position detecting means (not shown in the drawings) which directly determines the position of the ram 12, or via the output of a position detecting means provided in the punch driving source 15. In the case when a servo motor is used as the punch driving source 15, a pulse coder attached to the servo motor can be used as the position determining means.

The first determining means 97 determines whether there is a malfunction by means of determining the position of the ram 12 detected by the monitoring means 96 or by determining if the detected signal from the air pressure sensor 94 differs from the established parameters. In the present embodiment, the first determining means 97 is a strip failure detecting means which determines that a strip failure has occurred if the air pressure sensor 94 detects that the operating member 82 is not in contact with the punch 7 when the ram 12 has been relifted.

The second determining means 98 is a means to detect if the detecting function is malfunctioning. When the ram 12 is located between the position corresponding to the restored height of the punch 7 and the ram 12's highest ascension, and the air pressure sensor 94 detects a strip failure, the first determining means 98 is determined to be faulty.

The operation of the punch press will now be explained. The desired punch 7 and the die 8 of the upper and lower turrets 2, 3, respectively, are brought into striking position at ram position P by the rotation of the turrets 2, 3. The punch 7 to be used is selected from either the inner or outer row of the turret 2 through the movement of the striker 39 by selecting the cylinder 42 of the ram 12. The ram 12 is then lowered by the punch driving source 15, causing the desired punch 7 to be struck by the striker 39, and punching a punch hole in the work W.

When punch processing takes place, the valve 48 is opened at the ram position P. Compressed air is passed through the passage 32 of the punch 7 and ejected from a discharge hole at the tip of the shearing blade body 29. The ejected air prevents the punched out slug from popping up out of the die 8 and out of the work W, and forces the slug to drop out.

Figure 7C:
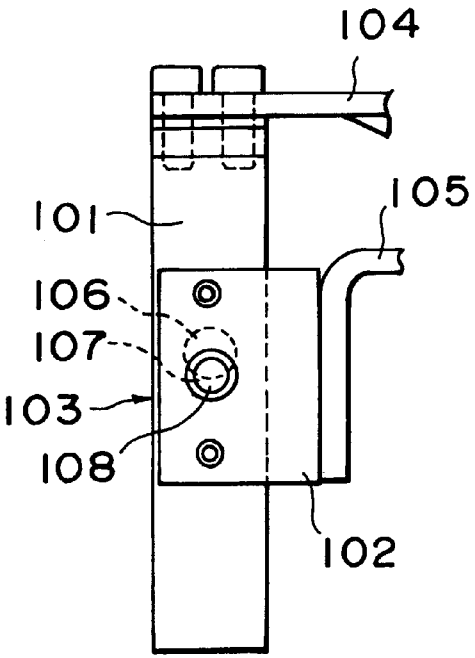
FIGS. 7A–C are a side elevation views showing the operation of the valve of FIG. 4.
Figure 7B:
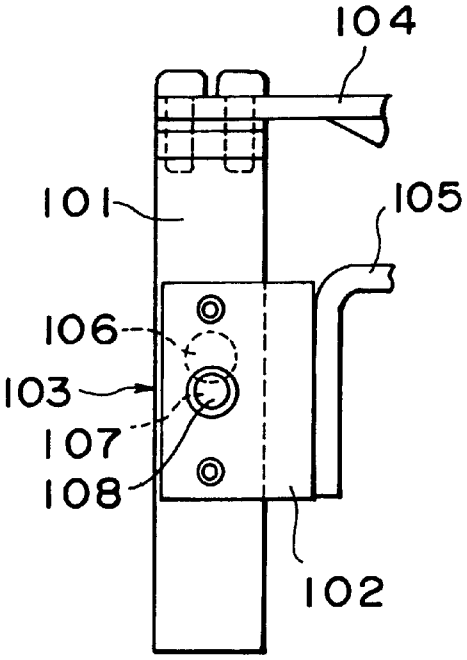
Figure 7A:
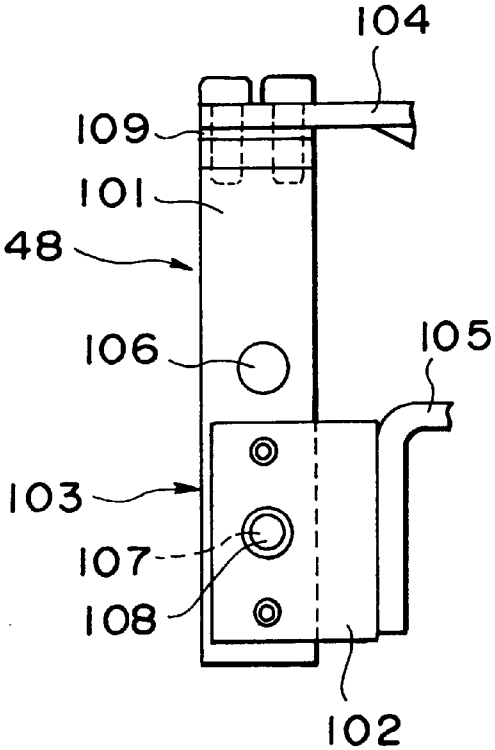

When the ram 12 is in its highest ascension, the movable member 101 of the valve 48 is positioned relatively higher than the stationary member 102, as shown in FIG. 7A. The fluid inlet hole 107 (FIG. 6A) and the fluid outlet hole 108 are thus obstructed by the movable member 101, forming a closed conduit. The movable member 101 falls bodily with the ram 12, and when the ram 12 reaches a predetermined height, the fluid inlet hole 107 and the fluid outlet hole 108 align with the through-hole 106 forming an unobstructed conduit as shown in FIG. 7B. Thus, compressed air is passed through the valve 48 into the passage 45 in the striker 39, and then supplied to the passage 32 inside the punch 7.

FIG. 8 shows the relationship between the opened (aligned) state of the valve 48 and the vertical position of the ram 12. Pairs A and B, B and F, C and G, and D and H in FIG. 8 show various states of the valve during operation.

Figure 8A:
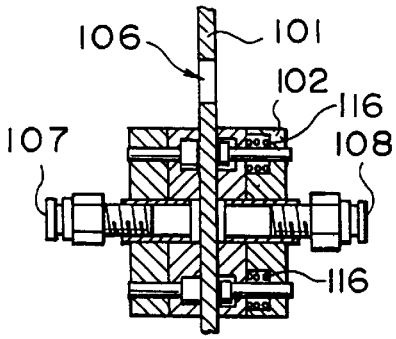
FIGS. 8 A–I are diagrams illustrating the operation of the valve of FIGS. 5–7 and the corresponding operation of the ram means of the punch press.
Figure 8B:
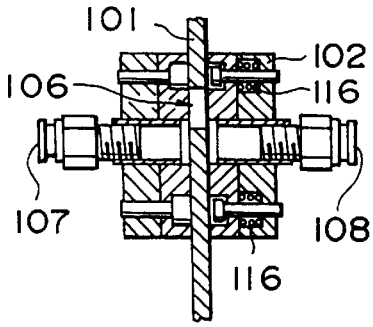
Figure 8C:
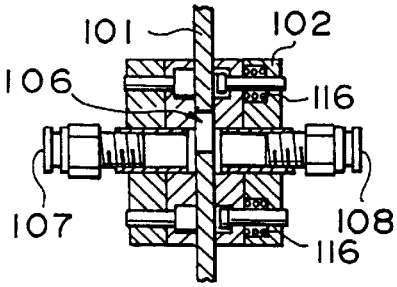
Figure 8D:
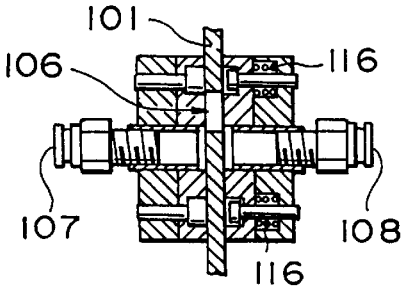
Figure 8E:
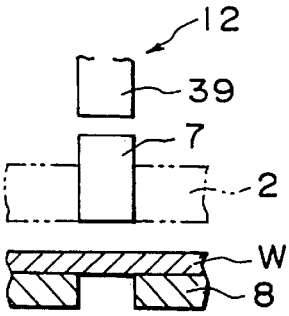
Figure 8F:
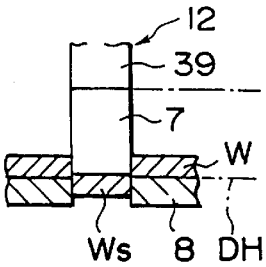
Figure 8G:
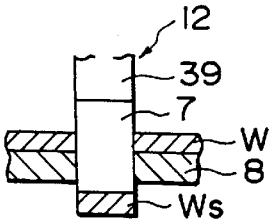
Figure 8H:
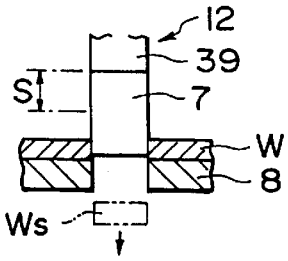

When the raised ram 12 in FIG. 8E is lowered, and reaches a predetermined height slightly above its dead bottom position (as shown in FIG. 8), the fluid inlet hole 107 and the fluid outlet hole 108 come into alignment with the through-hole 106, as shown in FIG. 8B and FIG. 7B. The fixed height at which the fluid inlet hole 107 and the fluid outlet hole 108 align with the through-hole 106 and open the conduit is set at the position where the bottom of the punch 7 reaches the position denoted in this example as DH (Die Height). The alignment of these passages permits the start of air supply to the passage 32 inside the punch 7. This supply of air is maintained after reaching this alignment, after the ram 12 reaches its dead bottom position (the state shown in FIG. 7C, FIG. 8C and FIG. 8G), and until the ram 12 returns to the predetermined height DH at which the passage was opened. In other words, air supply is maintained over the entire vertical range denoted by S in FIG. 8.

Hence, discharge of compressed air from the punch 7 is maintained for a short moment after the punch process is completed. Consequentially, the slug Ws is reliably forced out, and the prevention of the slug Ws from popping out becomes more effective. In other words, contrary to conventional machines that only eject a discharge air the instant the ram reaches its dead bottom position and thus create a vacuum at the surface of the work which can pull the slug upwards with the punch 7, when the punch 7 and the upper surface of the slug Ws come into contact in a punch press of the present invention, air discharge is continued even when the ram is slightly above its dead bottom position, no vacuum is created, and consequentially the slug Ws is forced out with a higher degree of reliability.

In order to reliably force out the slug, the vertical range S should preferably be made relatively large. In order to decrease wasted air discharge, the following design is preferable. When the punch 7 is lowered and the bottom of the punch 7 approaches the die height DH, the vertical range S is set such that the fluid inlet hole 107 and the fluid outlet hole 108 begin to align through the through-hole 106, thus reducing the wasted air discharge before the punch 7 contacts the work W. Further, wasted air discharge is prevented even if the height of the punch 7 is changed.

Figure 8I:
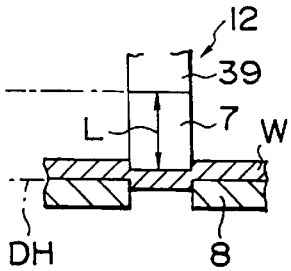

In other words, the shearing blade body 29 of the punch 7 may be shortened due to abrasion or repolishing. Normally changes in the height of the shearing blade body 29 must be dealt with by adjusting the height of the part of the punch 7 which is struck by the ram 12 and which is attached to the top part of the punch 7 with something like a screw. This kind of adjustment can be used to adjust the heights of all the punch 7. However, this adjustment must be performed by the operator, and there may be times when the operator forgets to make the necessary adjustments, or makes improper adjustments. In such instances, the length L of the punch 7 is shortened (as shown in FIG. 8I), but the length that is lost will be less than the thickness of the work W. Thus, even if the adjustment of the height of the punch 7 after repolishing is inaccurate, the height at which the connection is opened through the through-hole 106 is set at the die height DH, and the connection is formed at or near the die height DH, and as shown in FIG. 8I, the connection is formed when the punch 7 is punching into the work W. Thus, even if the adjustment of the height of the punch 7 after repolishing is inaccurate, the difference in height is compensated by the thickness of the work W, and wasted air discharge is prevented. Further, the amount of time that the air is discharged can be lengthened, enabling the slug Ws to be more reliably forced out.

The punch press of the present invention thus reliably forces out the slug and prevents the wasting of compressed air during air discharge. Further, since the valve 48 which is used to supply the compressed air is opened and closed in accordance with the movement of the ram 12, a separate driving source is unnecessary, the design is simple, and control of the air supply occurs in response to the rise and fall of the ram 12.

The malfunction detection means 80 functions as described below. When a strip failure is created during punch processing, or in other words, when the punched out work W fails to dislodge from the shearing blade body 29 of the punch 7, preventing the punch 7 from returning to its set height. When the punch 7 is unable to return to its highest ascension, the striker 39 of the ram 2 separates from the punch 7. Thus, the operating member 82 is pushed down by the force of spring 81 (as shown in FIG. 10D), and the air exhaust passage 89 is opened.

Figure 10D:
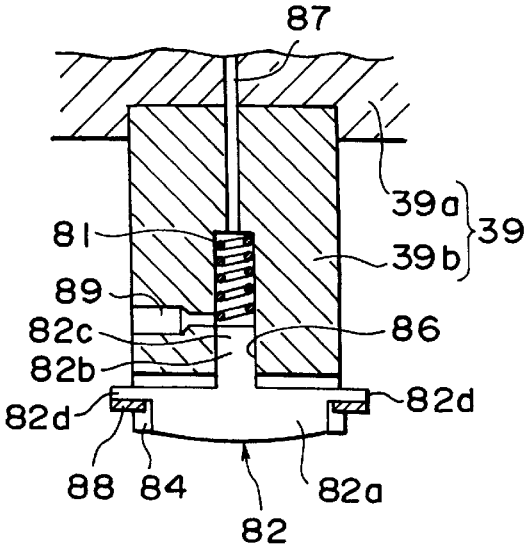

In other words, as shown in FIG. 10D, the operating member 82 is lowered inside the striker 39 when not thrust against the punch 7, and the air exhaust passage 89 from the air passage 87 is opened. Further, when the operating member 82 is pressed against the punch 7 by the striker 29, it rises up, as shown in FIG. 10A, and closes the air discharge passage 89. Thus, when a strip failure occurs, the striker 39 rises until it reaches the set position to which the punch 7 is relifted, the operating member 82 falls against the striker 39, and the air discharge passage 89 is opened. The operating member 82 remains lowered and the air discharge passage 89 remains open while the striker 39 returns to the fixed height corresponding to the relifted height of the punch 7.

When the air discharge passage 89 is opened and the air pressure in the air passage 87 decreases, this decrease in air pressure is detected by the air pressure sensor 94.

When the first determining means 97 detects that the air pressure reduction detected by the air pressure sensor 94 occurs faster than normal, in other words, when the ram 12 is relifted, it is detected that a strip failure has occurred.

Thus, the malfunction detection means 80 thus organized is able to determine whether or not a strip failure has occurred by detecting the state of the operating member 82 arranged in the striker 39, and by determining the vertical position of the striker 39. Moreover, contrary to conventional strip failure detection means that run an electric current between the striker and the punch and can fail to reliably detect strip failures because of insufficient contact between the ram and punch, and because of insulation of the punch head impeeding the current, this malfunction detection means reliably detects the strip failures. Further, the operating member 82 is arranged as an independent part of the striker 39 that strikes the punch 7, and since it does not bear the load of the striker 39, the longevity of the malfunction detection means 80 can be improved.

Packing may be used to seal the connection between the passage 32 in the punch 7 and the passage 45 in the striker 39 so that when the striker 39 meets the punch 7 the connection between the passages 45 is air-tight. However, in the present embodiment, the operating member 82 is positioned at a distance from the center of the striker body 39*b*, and in order not to obstruct the sinking of the operating member 82 into the striker body 39*b*, packing is not used.

The second determining means 98 determines that there is a malfunction when the air pressure sensor 94 detects that the punch 7 and the striker 39 are in contact when the ram 12 is positioned between its fixed height corresponding to the highest ascension of the punch 7 and the ram 12 dead top position. This malfunction detection may be caused by strip failure or a faulty sensor.

When the ram 12 is positioned between the fixed height corresponding to the restored height of the punch 7 and its highest ascension, it is not possible for the punch 7 and the striker 39 to be in contact during normal operation. Consequentially, when the air pressure sensor 94 detects that the punch 7 and the striker 39 are in contact when the ram 12 is in this range, a malfunction is detected. Provided with this kind of the malfunction determining means 98, an operator can instantly tell if there is damaged caused by a stripping malfunction. Thus, the reliability of the strip miss detecting function is improved.

In such a punch press, the forcing out of the slug can be performed reliably, and stripping malfunctions can be reliably detected.

In the embodiment described above, the valve 48 may be structured as shown in FIG. 11 through FIG. 14. The valve 48B in this example is formed from the rod shaped stationary member 49 and the tubular moving member 50 which is engaged and permitted to slide against the surface of the stationary member 49. The stationary member 49 is attached at the bottom to the ram guide 40 through the connecting member 51. The tubular moving member 50 is affixed at the top to the ram 12 through the connecting member 52. The stationary member 49 and the moving member 50 are provided with the passages 53 and 54, respectively, which move between connected and obstructed states in response to the rise and fall of the moving member 50.

Figure 11:
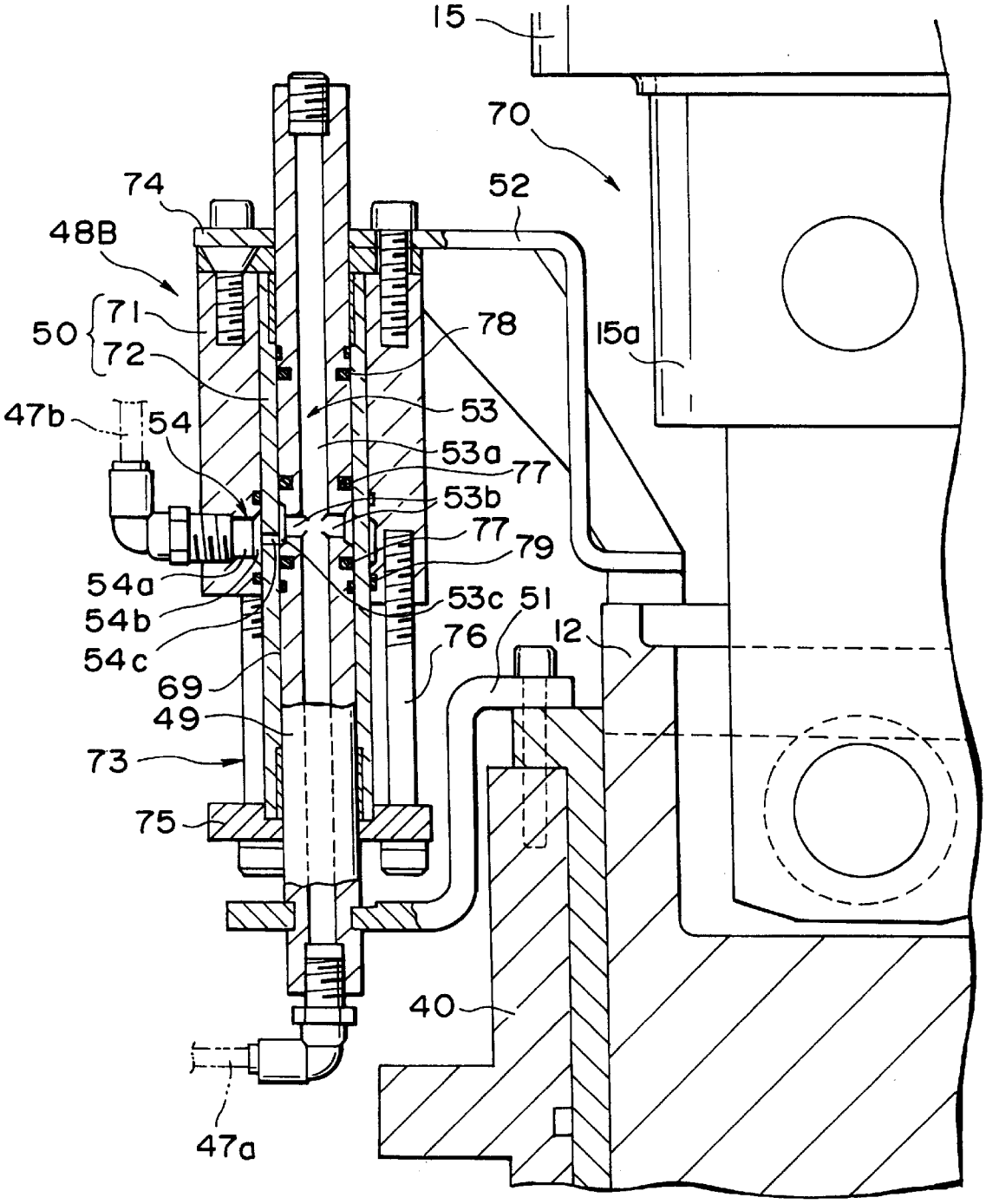
FIG. 11 is side elevation view, partly in cross-section, a valve according to another embodiment of the present invention.

As enlarged in FIG. 11, the stationary member 49 of the valve 48B is provided with the vertical passage section 53*a* of the passage 53 which extends vertically through the center of the valve. The vertical passage section 53*a* is formed as a vertically extending hole capped at the top. The bottom of the vertical passage section 53*a* becomes a fluid outlet hole which connects with the fluid pipe 47*a* through a pipe joint. The opening 53*c* of the passage 53 is formed in the sliding section 69 between the stationary member 49 and the movable member 50 in the outer surface somewhere in the mid-height section of the stationary member 49. This opening 53*c* is formed as a rounded, groove the bottom circumference of which contains at multiple fixed locations a number of lateral passage sections 53*b* which join the vertical passage section 53*a* with the opening 53*c*. The opening 53*c* which is formed as a rounded groove is formed so as to widen vertically from the lateral passage section passage 53*b*. This passage widens in the sliding direction of the movable member 50 into the opening 53*c* which is slightly larger than the opening 54*c* of the movable member 50.

The movable member 50 is comprised of two elements, a movable member body 71 and a sleeve 72 which is engaged so as to slide inside a hole formed in the movable member body 71. The sleeve 72 slides against the outside of the stationary member 49.

A cap 74 which is provided with a hole passing through the stationary member 49 is provided at the top of the movable member body 71, and this cap 74 controls the top position of the sleeve 72. The cap 74 is bolted to the movable member body 71. The movable member 50 is connected to the top surface of the cap 74 and affixed with a separate bolt to the connecting member 52.

A sleeve bottom holding member 75 is arranged at a distance below the movable member body 71. The sleeve bottom holding member 75 receives the bottom of the sleeve 72 which is inserted into a hole in its upper surface.

The passage 54 of the movable member 50 is formed of a body passage section 54*a* provided in the movable member body 71 and an opening 54*c* provided in the sleeve 72. The opening 54*c* in the sleeve 72 is formed in the passage 54 of the sliding section 69 wherein the stationary member 49 and the movable member 50 slide against each other. This opening 54*c* forms a through-hole, and is arranged in multiple positions around the circumference of the sleeve 72. The passage section 54*a* is comprised of a single hole extending laterally inside the movable section body 71, and tapered passage section 54*b* provided in the inner surface of the movable section body 71. The tapered passage section 54*b* is formed as a rounded groove tapered out towards the outer surface in the longitudinal direction of the sleeve 72, its radius at the outermost end larger than that of the opening 54*c*. The opening of the other end of the body passage section 54*a* is the entrance hole, and connects through a joint to the pipe 47*b* formed of a flexible tube and to the fluid supply passage 47.

Seals 77 and 78 are arranged in the outer surface of the stationary member 49 above and below the openings 53*c* which form a circular groove in order to prevent air from leaking out of the sliding member 69. Further, seals 79 are provided in the inner surface of the movable member body 71 of the movable member 50 and are arranged above and below the tapered passage section 54*b* formed in the tubular groove in order to prevent air from leaking out from between the movable member body 71 and the sleeve 72. The seals 77 and 78 are composed of O-rings or the like which are inserted around the tubular groove formed in the outer surface of the stationary member 49. The seal 79 is composed of an O-ring which is inserted around the tubular groove of the inner surface of the movable member body 71.

Figure 12B:
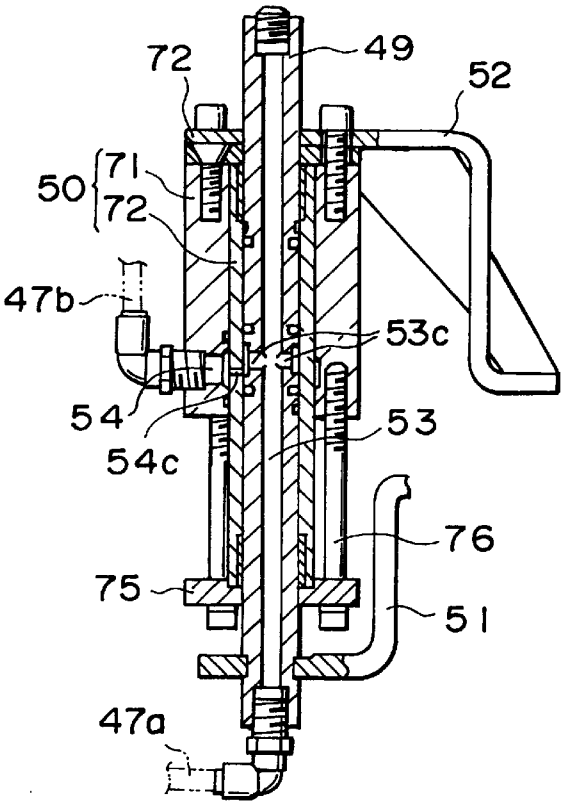
FIGS. 12A and B are side elevation views, in cross-section, of the valve of FIG. 11 showing the valve during operation.
Figure 12A:
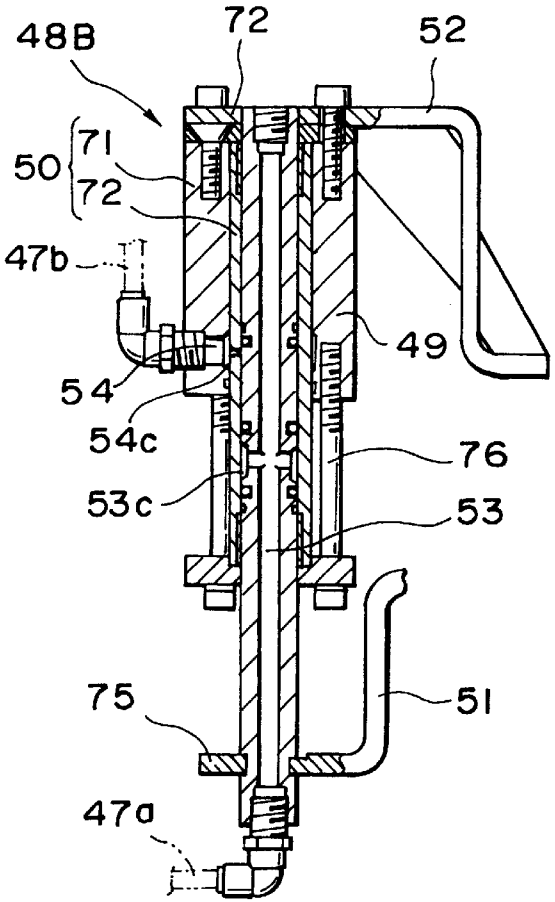
Figure 13A:
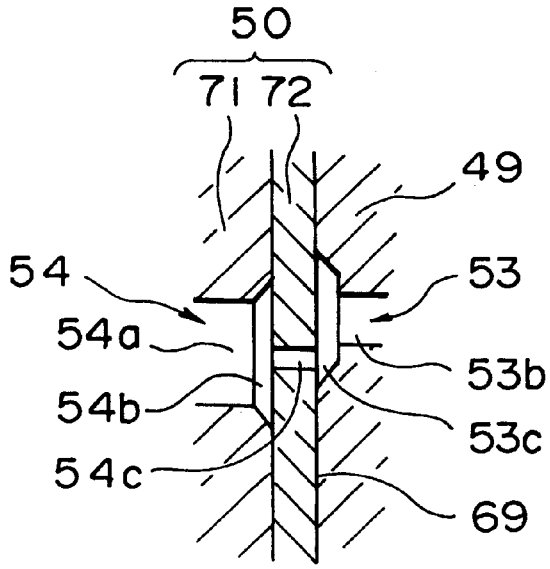
FIG. 13A is an enlarged cross-section diagram showing the openings and surrounding area of the valve of FIG. 11.
Figure 13B:
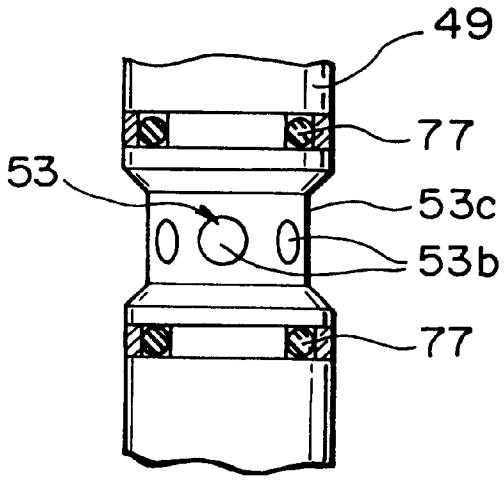
FIG. 13B is an enlarged diagram showing the openings of the rod-shaped stationary member of the valve of FIG. 11.

When the ram 12 is in its rising state, as shown in FIG. 12A, the movable member 50 is relatively higher than the stationary member 49, both passages 53, 54 are obstructed, and the valve 48B is closed. When the movable member 50 falls bodily with the ram 12 and the ram 12 reaches a predetermined location, as shown in FIG. 12B, the passages 53, 54 of the stationary member 49 and the movable member 50 align. This permits compressed air to pass through the valve 48*b*, through the flow passage 45 inside the striker 39, and to be supplied to the passage 32 inside the punch 7.

FIG. 14 shows the relationship between the alignment of the passages 53 and 54 and the rise and fall of the ram 12. Figures A and E, B and F, C and G, and D and H each show the corresponding states of the alignment according to operation of the ram 12.

Figure 14A:
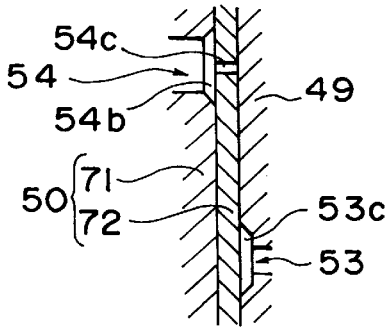
FIGS. 14A–I illustrate the operation of the valve of FIG. 11 and the corresponding the operation of the ram means.
Figure 14B:
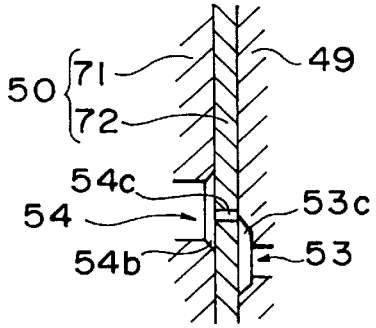
Figure 14C:
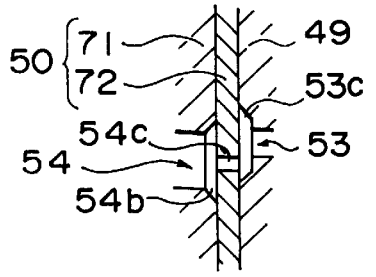
Figure 14D:
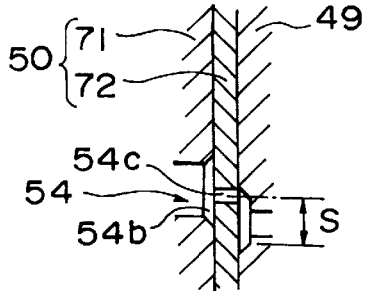
Figure 14E:
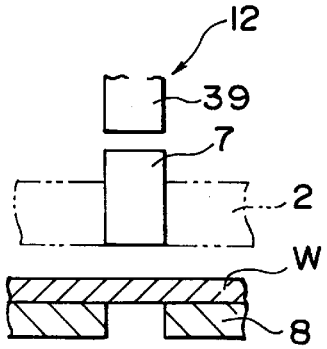
Figure 14F:
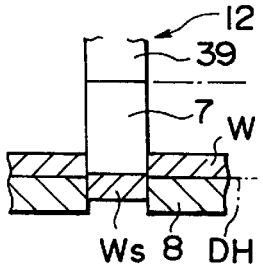
Figure 14G:
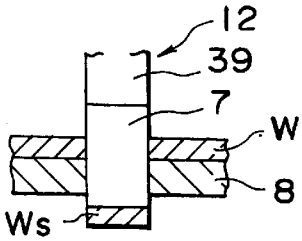
Figure 14H:
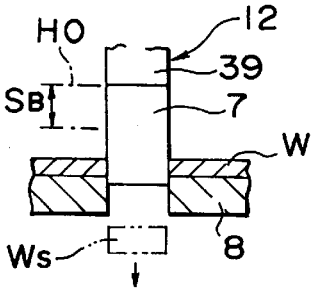
Figure 14I:
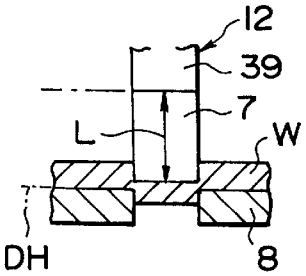

From the rising state of the ram 12 shown in FIG. 14E, the ram 12 drops down and when it reaches a fixed point above its dead bottom position (this point shown in FIG. 14F), the passage openings 53*c* of the stationary member 49 and the openings 54*c* of the movable member 50 of the valve 48*b* begin to come into alignment (as shown in FIG. 14B). The set height at which this alignment begins in this example is the height at which the bottom of the punch 7 reaches the die height DH. The start of this alignment opens the valve and starts the supply of air to the passage 32 inside the punch 7. After the passages have come into alignment and the ram 12 continues past its dead bottom position, all of the opening 54*c* of the movable member 50 aligns with the opening 53*c* of the movable member 49, and the valve becomes completely open. The complete opening of the valve occurs when the ram 12 reaches its dead bottom position (shown in FIG. 14G), and the complete opening of the valves is maintained until the ram 12 is lifted beyond fixed height HO (shown in FIG. 14H) and passed out of a vertical range $S_B$.

Figure 15:
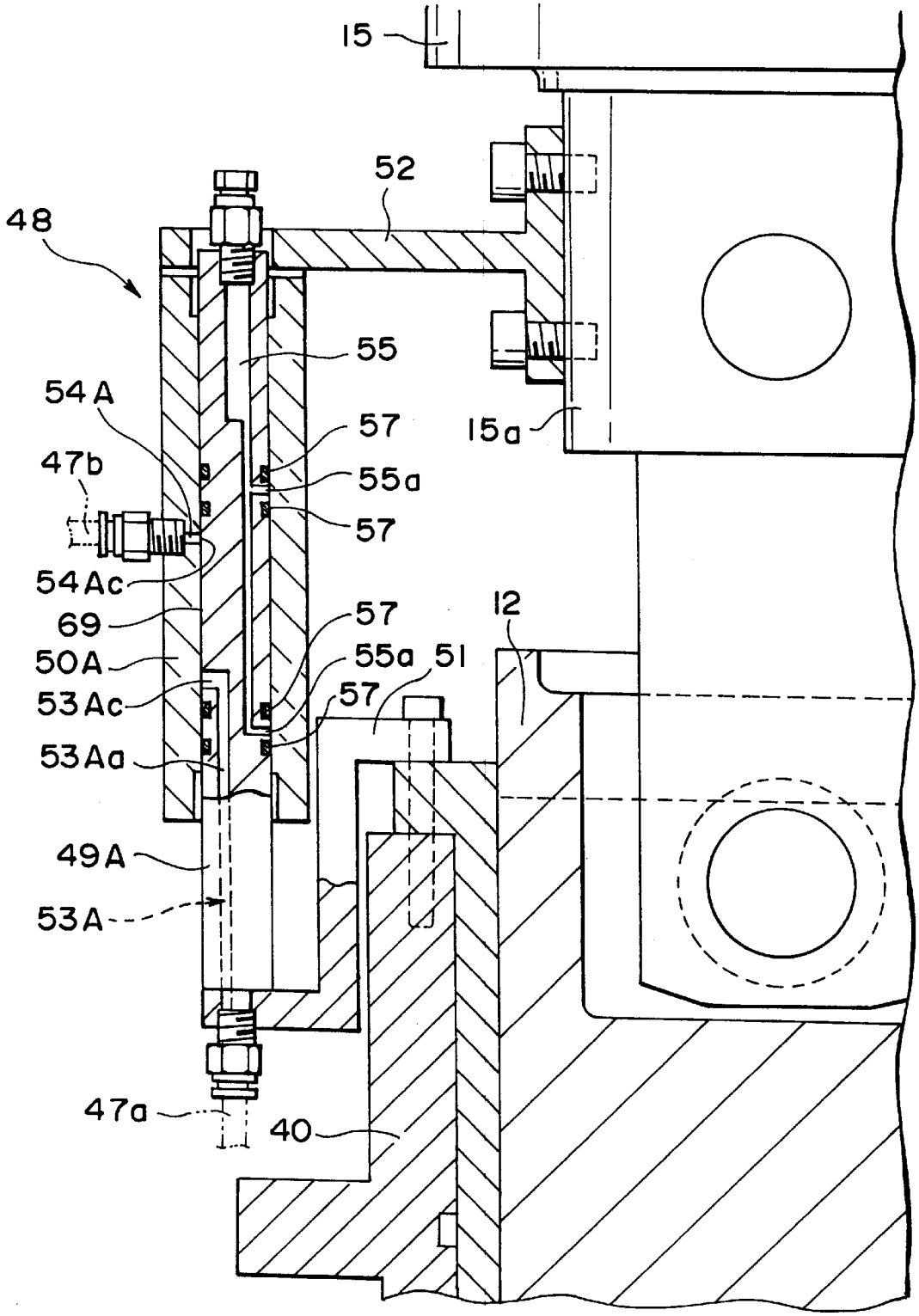
FIG. 15 is a side elevation view, partly in cross-section, a valve according to a yet another embodiment of the present invention.
Figure 16B:
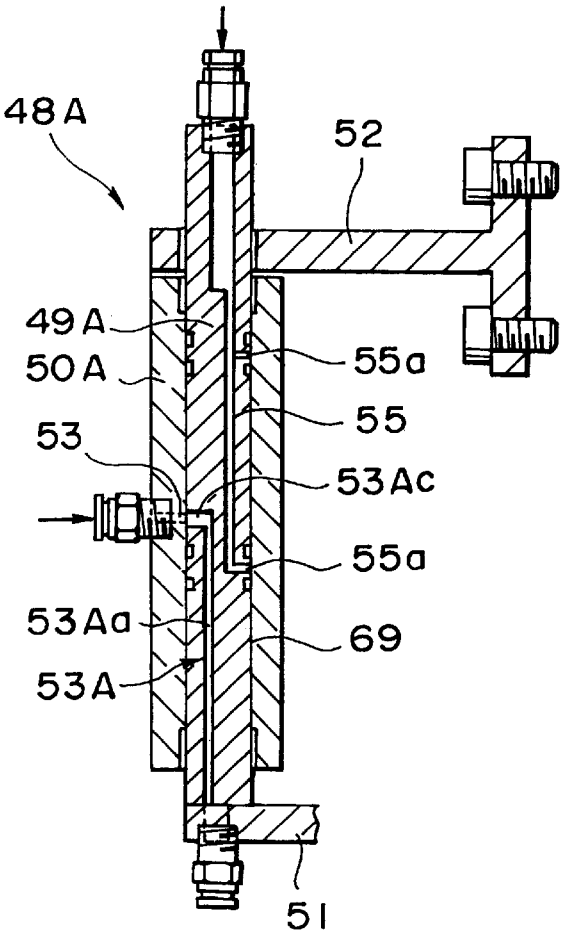
FIGS. 16A and B are side elevation views, in cross section, of the valve of FIG. 15 illustrating the operation of the valve.
Figure 16A:
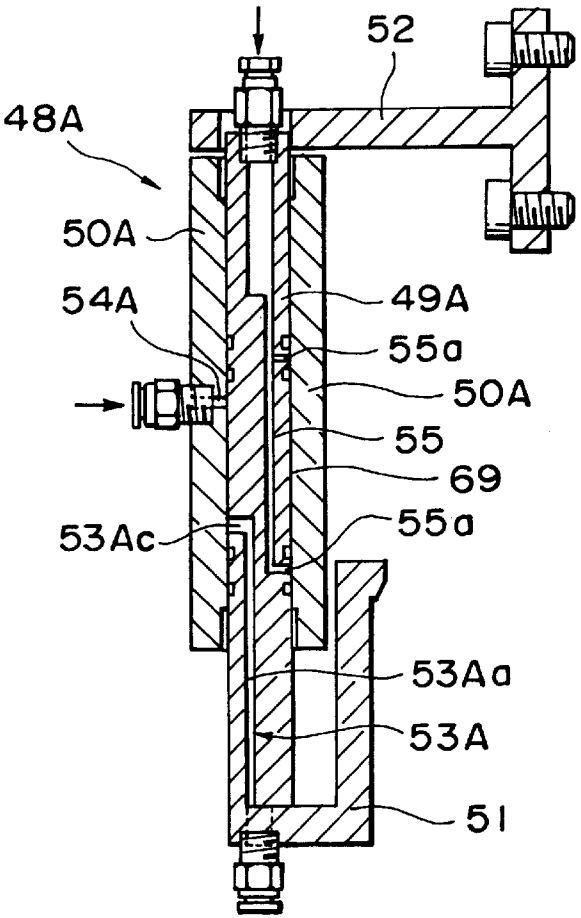
Figure 17A:
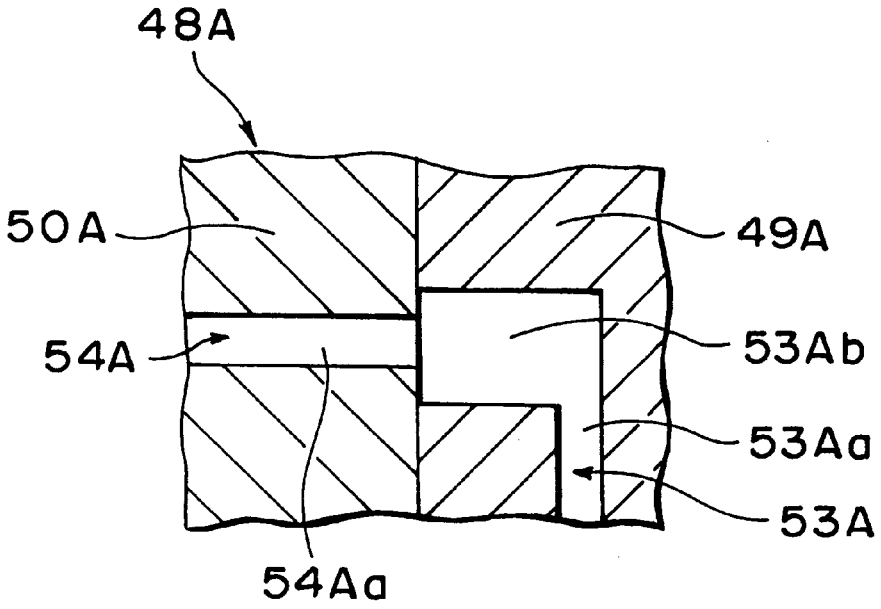
FIGS. 17A and B are enlarged cross-section diagrams showing the shapes of the fluid hole openings of the valve of FIG. 15.
Figure 17B:
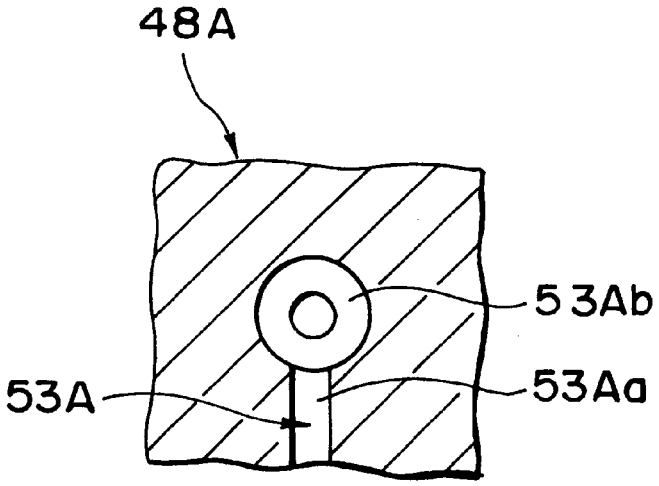

The valve depicted in the embodiment above may be changed according to the following alternate embodiment described in reference to FIG. 15 through FIG. 17. This valve 48A engages the movable member 50A which is attached bodily to the ram outside of the stationary section 49A, and slides against it. The stationary member 49A and the movable member 50A are attached to the ram guide 40 and the ram 12, respectively, via the connecting members 51 and 52, respectively.

The passage 54A provided with the opening 54Ac which opens into the sliding section 69 between the movable member 50A and the stationary member 49A is provided at mid-height in the movable member 50A. The opening of the entrance side of the passage 54A is connected to the air supply source 46 (shown in FIG. 4) via the fluid pipe 47*b* which forms part of the air supply passageway 47.

The stationary member 49A is provided with the air supply passage 53A and an oil supply passage 55 which flows lubricating oil inside the valve. The air passage 53Aa is composed of a vertical passage section 53Aa which extends from the bottom of the stationary member 49A and curves into a lateral passage section. The lateral passage section is provided with an opening 53Ac which opens into the sliding section 69. The opening at the bottom of the vertical passage section 53Aa is attached to the fluid pipe 47*a*.

The opening 53Ac of the sliding section 69 of the stationary member 49A is tapered and widens out in the sliding direction of the movable member 50A to a radius larger than that of the opening 54Ac of the movable member 50A. This widening section establishes the vertical range of the ram means 70 in which the dead bottom position is included, and inside which the opening 53Ac of the stationary member 50A and the opening 54Ac of the sliding section 69 of the movable member 50A align to maintain the valve in a completely open state.

Moreover, as shown in this embodiment, when the opening 53Ac of the stationary member 49A and the opening 54Ac of the movable member 50A are formed in the valve 48A such that one of the holes widens to a diameter larger than the other in the sliding direction of the movable member 50A, the following benefits are achieved. Namely, by appropriately setting the size of the larger opening 53Ac which opens in the sliding direction, the range of the completely opened state of the valve can thus be set. This makes setting the range in which the valve is completely open very simple.

As shown in FIG. 15, the inner valve lubricating oil supply passage 55 of the stationary member 49A extends in a vertical direction from its upper end, and is formed such that lubricating oil outlet holes 55*a* open into the sliding section 69 in a position slightly below the opening section of the air supply passage 53A and slightly above the air supply passage 53A of the movable member 50A when the ram 12 is at its highest ascension. The seals 57 which prevent air from leaking out of the sliding section 69 are provided above and below each lubricating oil outlet hole 55*a*. These seals 57 use O-rings that fit around the rounded grooves provided on the surface of the stationary member 49A. The opening end of the inner valve lubricating oil supply passage 55 is attached through a tube to the lubricating oil supply source (not shown in the drawings).

When thus supplied with the inner valve lubricating oil supply passage 55, sliding of the sliding member 50A between the stationary member 49A and the movable member 50A occurs smoothly.

Moreover, as shown in the embodiments of FIG. 11 through FIG. 14, when the movable member 50 of the valve 48 is structured in two parts, the inner valve lubricating oil supply passage 55 can be provided, as shown in the embodiments in FIG. 15 and FIG. 16.

Figure 18A:
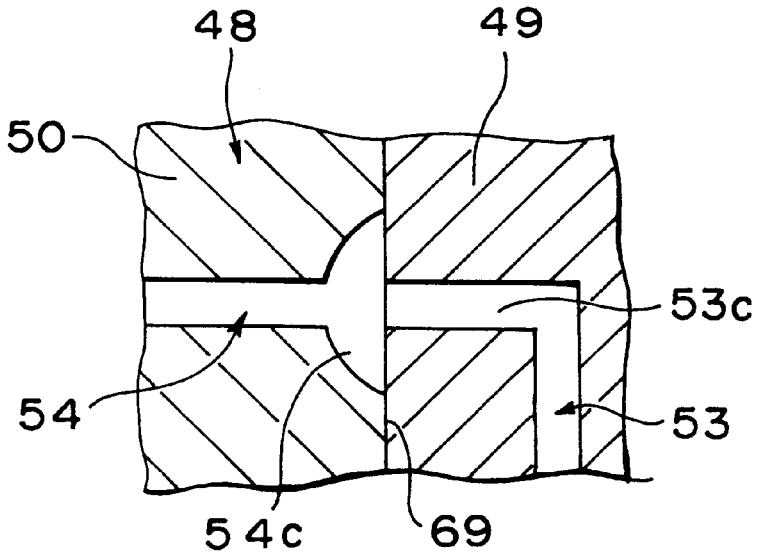
FIGS. 18A and B are enlarged cross-section diagrams showing alternative shapes of the fluid hole openings of the valve of FIG. 15.
Figure 18B:
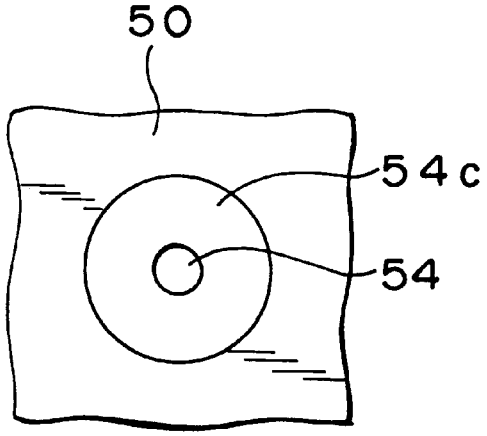

In the above described embodiment, the opening formed so as to taper out in the sliding direction in the sliding section 69 of the valves 48A and 48B are provided in the the stationary members 49 and 49A, but conversely, they can also be formed in the opening 54*c* of the passage 54 of the movable member 50 as shown in FIG. 18.

Figure 19A:
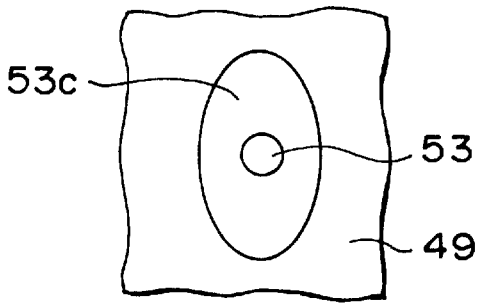
FIGS. 19A–F are front elevation views showing still further alternative shapes of the fluid hole openings of the valve of FIG. 15.
Figure 19B:
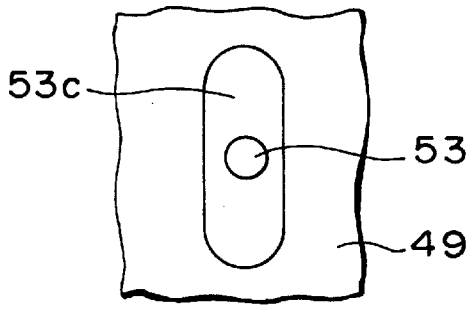
Figure 19C:
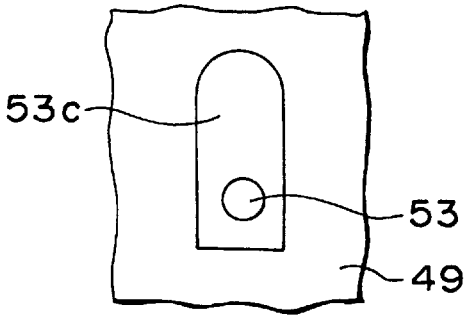
Figure 19D:
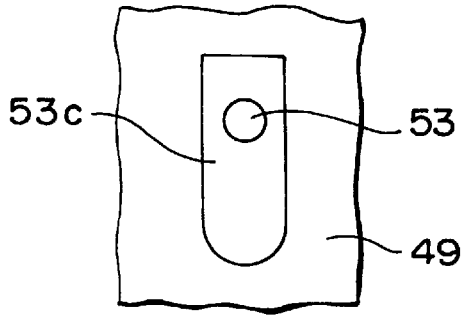
Figure 19E:
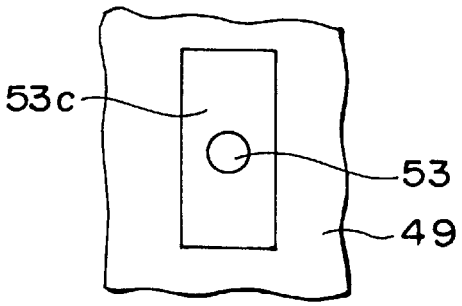
Figure 19F:
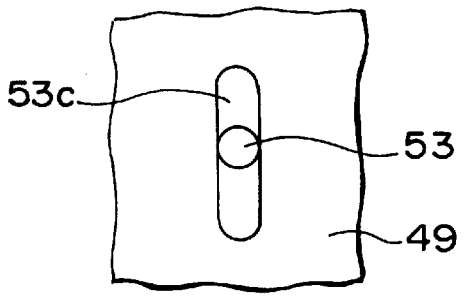

Further, the openings of the sliding section 69 provided in the passages 53 and 54 can be formed in the sliding direction in both the stationary member 49 and the movable member 50. Still further, these tapered openings can take on various shapes as shown in the examples in FIG. 19A through FIG. 19F. For example, FIG. 19A shows an elliptical opening 53*c*, FIG. 19B shows the opening 53*c* made into a groove shape with semi-circular ends, FIG. 19C and FIG. 19D are each examples of the opening 53*c* made into groove shapes with the top and bottom ends, respectively, ending in semi-circles, FIG. 19E is an example of the tapered opening 53*c* formed in a rectangular shape, FIG. 19F is an example of the tapered opening 53*c* made into a groove-like shape as in FIG. 19B, but of the same width as the passage 53.

Figure 20:
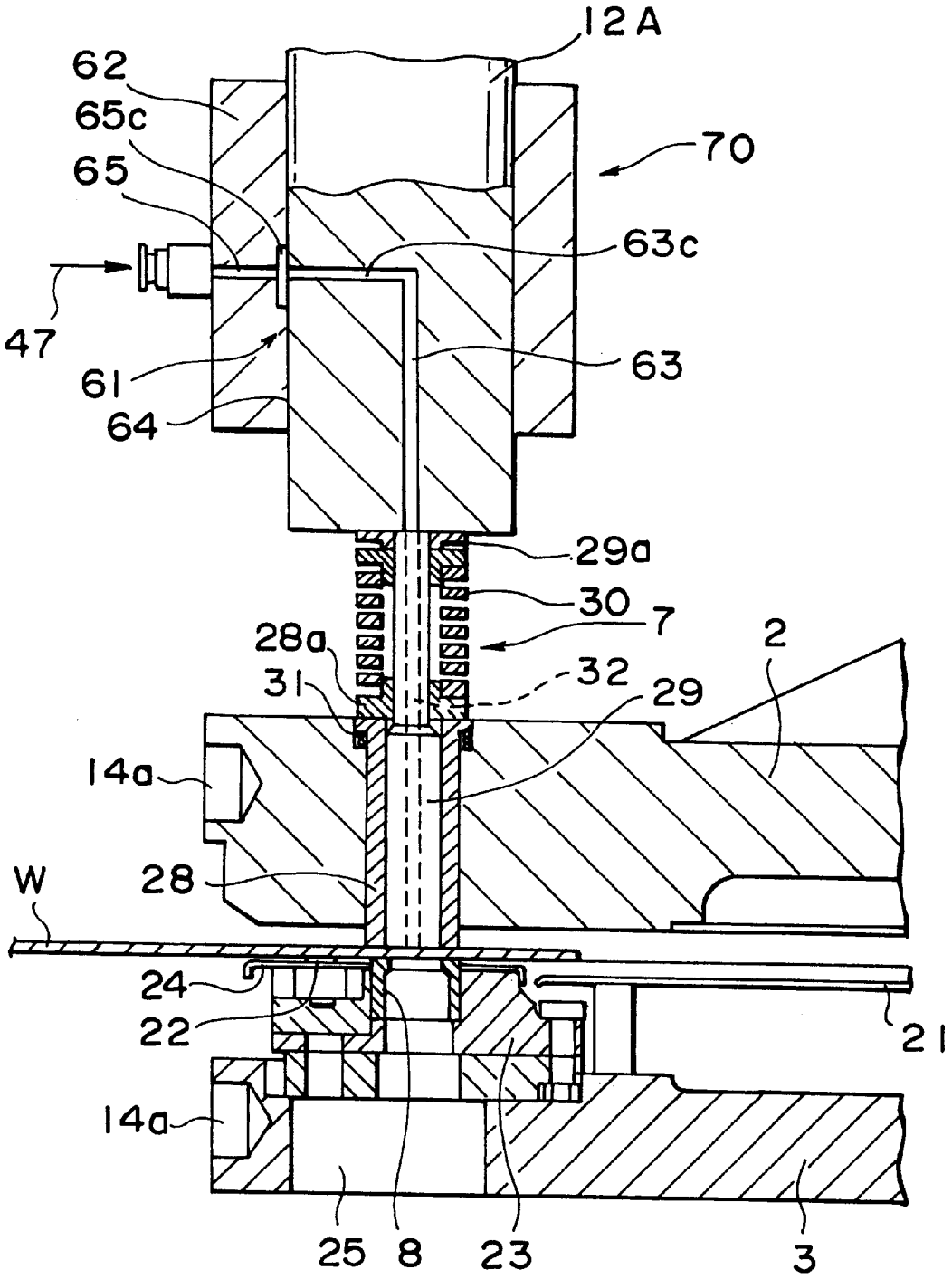
FIG. 20 is a side elevation view, in cross-section, of a portion of a punch press according to an alternative embodiment of the present invention.

FIG. 20 shows an alternate embodiment of the present invention. In this embodiment, the punch 7 of the turret 2 is provided with only a single row of punch tools, and the ram 12A lacks a strike position selection means for adjusting the strike position or the ram 12A. Further, a valve 61 provided with the fluid supply passage 47 is comprised of the sliding section 64 between the ram guide 62 and the ram 12A as a movable member. An entrance opening 63*c* of a passage 63 which is provided in the ram 12A is provided at the sliding section 64 between the ram 12A and the ram guide 62. The outlet side opening of the passage 63 is arranged at the bottom of the ram 12, and connects with the passage 32 of the punch 7. The opening 65*c* of the passage 65 which is provided in the ram guide 62 opens at the sliding section 64, and is formed so as to be wider (in the sliding direction) than the corresponding opening 63*c*. The entrance opening of the passage 65 in the ram guide 62 is connected to the pressurized air supply source via a pipe. Otherwise, the organization of this embodiment is the same as the embodiments shown in FIG. 1 through FIG. 10.

The punch press described in this alternate embodiment, like the previously described punch presses, reliably forces out slugs and performs air discharge economically in a simple and effective design.

Further, the present embodiment may also be modified by making the tapered opening in either the passage 63 of the ram guide 62 or the passage 65 of the ram 12A. Further, the shape of the tapered openings can also be altered to extend in different shapes in the sliding direction as described in FIG. 19.

The embodiments described above have been explained in reference to a turret style punch press, but a straight advancing cartridge can be used instead of the turret as the punch holding means to hold the punch 7 and the die 8. Further, other designs, such as a punch holding means that connects the part which holds the individual punches 7 and the dies 8 by means of a chain, can also be implemented with this invention.

Since the punch press of the present invention is equipped with a valve that forces out a slug by maintaining a passage when the ram means falls between a fixed vertical range which includes its dead bottom position, the slug is reliably forced out, and energy used to supply the air is not wasted. Further, since the valve is opened and closed by the movement of the ram means, a separate driving source is not required, and the design of the fluid control means is kept simple.

Since compressed air is used as the fluid, it can be supplied through the machine with unsophisticated machinery, and even if discharge of this fluid occurs before the punch strikes the work, the work is not sullied by the fluid.

When the valve is comprised of a sliding section, said sliding section comprised of a plate-shaped movable member which is provided with a through-hole and which is attached bodily to the ram means and a block-shaped stationary member that clamps the vertically sliding movable member wherein said valve is provided with a through-hole, a fluid inlet part, and a fluid outlet part which come into alignment in accordance with the rise and fall of the plate shaped movable member, the valve design is a relatively simple one-part construction, and the cost of manufacturing the valve can be minimized.

When the ram means is provided with a ram body, and a striker which is attached to and moves the bottom of the ram body in a lateral direction, and provided with a passage in the striker, the striker of the ram means is able to selectively strike a plurality of punches while still reliably forcing out the slugs.

When the valve is provided laterally of the ram means and the fluid outlet port of the valve and fluid inlet port of the ram means are linked by a pipe, a design in which fluid discharge accurately corresponds to the rise and fall of the ram means can be achieved.

What is claimed is:

1. A combination useful in a punch press adapted to receive a punch having (i) a fluid discharge orifice for discharging fluid into a die hole to eject a slug punched out during a punching process and (ii) a fluid inlet orifice communicating with the discharge orifice, the combination comprising:

a reciprocate ram having a forward stroke and a return stroke so as to be displaceable between a top dead position and a bottom dead position, the ram having a main body and a striker portion attached to the main body, a fluid outlet orifice for communicating with the inlet orifice on the punch when the ram strikes the punch, and a fluid inlet opening communicating with the fluid outlet orifice on the ram, wherein the fluid outlet orifice and the fluid inlet opening are disposed on the striker portion of the ram, and wherein the ram is selectively positionable laterally relative to a work piece for cooperation with different punch tools;

a fluid supply conduit for coupling the inlet opening on the ram with a source of fluid; and a valve in the fluid supply conduit, the valve opening in response to the position of the ram to establish communication between the fluid source and the inlet opening on the ram during a predetermined displacement of the ram, said predetermined displacement of the ram including, in sequence, a portion of the forward stroke of the ram, the bottom dead position of the ram, and a portion of the return stroke of the ram.

2. The combination, as defined in claim 1, in which:

the ram has an outer surface, the inlet opening on the ram being disposed along the outer surface of the ram; and wherein the combination further includes:

a ram guide having an inner surface slidably engaging the outer surface of the ram for guiding the ram, the ram guide including a fluid inlet orifice and a fluid outlet port, the fluid outlet port being disposed on the inner surface of the ram guide and in communication with the fluid inlet orifice on the ram guide, the valve including the outlet port on the ram guide, the inlet opening on the ram communicating with the outlet port on the ram guide during said predetermined displacement of the ram.

3. The combination, as defined in claim 2, in which:

both the inlet opening on the ram and the outlet port on the ram guide have substantially the same dimension in the direction of reciprocation of the ram.

4. The combination, as defined in claim 2, in which:

the inlet opening on the ram has a first dimension in the direction of reciprocation of the ram, and the outlet port on the ram guide has a second dimension in the direction of reciprocation of the ram, the second dimension being greater than the first dimension.

5. The combination, as defined in claim 2, in which:

the inlet opening on the ram has a first dimension in the direction of reciprocation of the ram, and the outlet port on the ram guide has a second dimension in the direction of reciprocation of the ram, the first dimension being greater than the second dimension.

6. The combination, as defined in claim 1, in which:

the valve includes a valve body and a valve member, the valve member being slidably movable relative to the valve body in response to the movement of the ram, the valve body including an outlet port in communication with the inlet opening on the ram, the movable valve member being adapted to establish communication between the fluid source and the outlet port on the valve body.

7. The combination, as defined in claim 6, in which:

the valve body includes a first portion and a second portion, the first portion including an inlet port adapted to be coupled to the fluid source and the second portion including said outlet port, said inlet and outlet ports being formed in opposed surfaces on the first and second valve body portions, respectively; and the movable valve member being sandwiched between the opposed surfaces on the valve body portions and slidable relative thereto, the movable valve member including a through-hole for establishing fluid communication between said inlet and outlet ports during said predetermined displacement of the ram.

8. The combination, as defined in claim 7, in which:

the opposed surfaces on the first and second valve body portions are planar surfaces; and the movable valve member comprises a plate.

9. The combination, as defined in claim 6, in which:

the valve body includes an outer, cylindrical surface, opposed ends and an inlet port formed in the cylindrical outer surface, the valve body outlet port being formed in one of the ends of the cylindrical valve body, the valve body inlet and outlet ports being in fluid communication; and the movable valve member comprising a tubular member having an inner surface in slidable engagement with the outer surface of the valve body, the movable valve member including fluid supply port formed in the inner surface thereof and connectable to the fluid source, the fluid supply port on the movable valve member and the inlet port on the valve body being in communication during said predetermined displacement of the ram.

10. The combination, as defined in claim 9, in which:

the fluid supply port on the movable valve member and the inlet port on the valve body have substantially the same dimension in the direction of reciprocation of the ram.

11. The combination, as defined in claim 9, in which:

the fluid supply port on the movable valve member has a first dimension in the direction of reciprocation of the ram, and the inlet port on the valve body has a second dimension in the direction of reciprocation of the ram, one of said first or second dimensions being greater than the other.

12. The combination, as defined in claim 9, in which:

the valve body defines a reservoir for retaining a lubricant, the valve body having at least one passage connecting the reservoir with the outer, cylindrical surface of the valve body.

13. The combination, as defined in claim 1, in which:

the ram includes a surface for engaging the punch and driving the punch during the punching process, the punch being biased to normally remain in contact with said ram surface during at least a portion of the return stroke of the ram;

and wherein the combination further includes:

an operating member, carried by the ram responsive to loss of contact between said ram surface and the punch during said portion of the return stroke of the ram for generating a signal indicative of said loss of contact.

* * * * *